US006916586B2

(12) United States Patent
Ishiyama et al.

(10) Patent No.: US 6,916,586 B2
(45) Date of Patent: Jul. 12, 2005

(54) TONER FOR ELECTROSTATIC CHARGED IMAGE DEVELOPMENT AND PROCESS FOR PREPARING THE SAME, AS WELL AS IMAGE FORMING METHOD, IMAGE FORMING APPARATUS AND TONER CARTRIDGE

(75) Inventors: Takao Ishiyama, Minamiashigara (JP); Hiroshi Nakazawa, Minamiashigara (JP); Shuji Sato, Minamiashigara (JP); Yosuke Tsurumi, Minamiashigara (JP); Yasuhiro Arima, Minamiashigara (JP); Takashi Imai, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 132 days.

(21) Appl. No.: 10/654,916

(22) Filed: Sep. 5, 2003

(65) Prior Publication Data

US 2004/0191656 A1 Sep. 30, 2004

(30) Foreign Application Priority Data

Mar. 24, 2003 (JP) ..... 2003-079943

(51) Int. Cl.[7] ..... G03G 9/083

(52) U.S. Cl. ..... 430/106.1; 430/111.4; 430/137.1

(58) Field of Search ..... 430/106.1, 111.4, 430/137.1

(56) References Cited

U.S. PATENT DOCUMENTS 6,096,465 A * 8/2000 Kadokura et al. ..... 430/137.14

* cited by examiner

*Primary Examiner*—Mark A. Chapman
(74) *Attorney, Agent, or Firm*—Oliff & Berridge, PLC

(57) ABSTRACT

The toner for electrostatic charged image development of the present invention is characterized in that it contains at least a binder resin, a mold releasing agent and magnetic metal particles, and the solubility of the magnetic metal particles in a 1 mol/l aqueous $HNO_3$ solution at 50° C. is 500 mg/g·l or less.

24 Claims, 2 Drawing Sheets

TONER FOR ELECTROSTATIC CHARGED IMAGE DEVELOPMENT AND PROCESS FOR PREPARING THE SAME, AS WELL AS IMAGE FORMING METHOD, IMAGE FORMING APPARATUS AND TONER CARTRIDGE

CROSS-REFERENCE TO RELATED APPLICATIONS

This application claims priority under 35 USC 119 from Japanese Patent Application No. 2003-79943, the disclosure of which is incorporated by reference herein.

BACKGROUND OF THE INVENTION

1. Field of the Invention

The present invention relates to a toner for electrostatic charged image development which is used when developing an electrostatic latent image formed by electrophotography, electrographic printing or the like with a developer, and also relates to a process for preparing the same, as well as an image forming method, an image forming apparatus and a toner cartridge.

2. Description of the Related Art

A method of visualizing image information via an electrostatic charged image such as electrophotography is currently utilized in a variety of fields. In electrophotography, image information is visualized by forming an electrostatic charged image on a photosensitive body by an electrifying step and an exposing step, developing the electrostatic latent image with a developer containing a toner, and a transferring step and a fixing step.

Known developers include a two-component developer composed of a toner and a carrier, and a one-component developer composed of a magnetic toner or a non-magnetic toner alone. Processes for preparing the toner include a kneading pulverizing method of melting and kneading a thermoplastic resin, a pigment, an electrification controlling agent and a mold releasing agent (such as a wax), cooling, finely-dividing and classifying the mixture is usually utilized. If necessary, in order to improve the flowability and the cleanability, there are cases where fine inorganic particles or fine organic particles are added to the toner particle surfaces. Although these methods provide a considerably excellent toner, they are problematic in certain areas, as described below.

A toner obtained by a normal kneading pulverizing method is undefined in toner shape and surface structure. In the kneading pulverizing method, it is difficult to intentionally control a toner shape and surface structure, although they subtly vary depending on the pulverizability of materials used and the conditions of a pulverizing step. In the kneading pulverizing method, the range of selection of materials is limited. Specifically, in the kneading pulverizing method, the resin and colorant dispersion must be materials that are sufficiently brittle and can be finely-divided with an economical manufacturing apparatus. However, when the resin and colorant dispersion are made to be brittle in order to satisfy this requirement, there are cases when the toner generates a further fine powder, or the toner shape is changed, due to a mechanical shearing force imparted in the developing machine.

Due to these influences, deterioration of electrification in a two-component developer is accelerated due to adhesion of fine powder to the carrier surface. In a one-component developer, toner flight is caused due to expanded particle size distribution, and the image quality is easily deteriorated due to reduction in the developability resulting from changes in the toner shape.

When a toner is prepared by internally adding a large amount of mold releasing agent such as wax, exposure of the mold releasing agent on the surface is caused in the toner in some cases, depending on the combination of the mold releasing agent and thermoplastic resin. In particular, in a combination of a thermoplastic resin which has increased elasticity due to a high molecular component and is slightly difficult to grind, and a wax which is brittle such as polyethylene and polypropylene, exposure of these wax components are observed on the toner surface in many cases. Although this is advantageous in the releasability at fixation and cleaning of untransferred toner from a photosensitive body, since polyethylene in a superficial layer is easily moved by a mechanical force, dirtying of a developing roll, a photosensitive body, and a carrier is easily caused, leading to reduced reliability.

A toner can have insufficient flowability even when a flowing aid is added if the toner shape is undefined. For this reason, movement of a fine particles on the toner surface into concave portions of the toner due to mechanical shearing force during use reduces flowability with time, causes embedment of the flowing aid into the interior of a toner, and deteriorates the developability, transferability and, cleanability. When a toner recovered by cleaning is returned to a developing machine and used, the image quality is further easily reduced. In order to prevent this, when the flowing aid is further increased, black points are generated on the photosensitive body and flight of aid particles occurs.

In recent years, as the means for intentionally controlling toner shape and surface structure, a process for preparing a toner by an emulsion polymerization aggregating method is provided in Japanese Patent Application Laid-Open (JP-A) Nos. 63-282752 and 6-250439. This process is generally a process of preparing a toner by making a resin dispersion by emulsion polymerization and, separately, making a colorant dispersion in which a colorant is dispersed in a solvent and, thereafter, mixing them to form an aggregate corresponding to a toner particle diameter, and heating to fuse and coalesce the aggregate.

By this process, a toner shape can be controlled to a degree, and the electrifiability and the durability of a toner can be improved. However, since the internal structure of the toner becomes approximately uniform, there remains a problem on the releasability of a sheet to be fixed upon fixation, and the environment-dependent stability of electrification.

In such electrophotographic processes, in order to stably maintain toner performance even under various mechanical stresses, it is necessary to suppress exposure of the mold releasing agent on the surface, enhance the surface hardness without deteriorating the fixability and, at the same time, improve the mechanical strength of the toner itself, and satisfy the need for both sufficient electrifiability and fixability.

In recent years, there is increased demand for higher image quality and, in image formation, there is a remarkable tendency of miniaturization of a toner in order to realize high-precision imaging. However, with simple miniaturization under the conventional particle size distribution, the presence of fine powder side toner makes dirtying of a carrier and a photosensitive body, as well as toner flight remarkably problematic, and it is difficult to realize both high image quality and high reliability at the same time. For this reason, it is necessary that particle size distribution be sharpened, and miniaturization of a toner be possible.

In addition, from the viewpoint of the recent demand for increasing speed while lowering energy consumption, obtaining uniform electrifiability, durability, toner strength, and sharpness of particle size distribution are becoming increasingly important. Further, in light of increased speed and energy saving, fixability at further lower temperatures becomes necessary. Also from these points, wet processes for preparing toners such as an aggregating coalescent toner, a suspension polymerization toner, and a suspension granulation toner have excellent properties, and wet processes are ideal for providing sharp particle size distribution and for preparing a toner having small particle diameter.

Generally, a polyolefin type wax is internally added to a mold releasing agent component for the purpose of preventing low temperature offset at fixation. In addition, in conjunction with this, there are efforts to improve high temperature offset by uniformly coating a minor amount of silicone oil on the fixing roller. For this reason, silicone oil is adhered on an outputted output transfer receiving material, which is not preferable because when this is handled, the material has a sticky unpleasant feeling.

For this reason, JP-A No. 5-061239 describes a toner for oil-less fixation in which a large amount of mold releasing agent component is internally contained in a toner. However, in this case, although addition of a large amount of mold releasing agent can improve the releasability to an extent, it is difficult to realize stable peeling since compatibility between the binder component and mold releasing agent occurs, and stable exudation of the mold releasing agent is not uniform. Further, since the means for controlling the aggregating force of a binder resin in a toner depends on the Mw and Tg of a binder, it is difficult to directly control the thread-forming property and the aggregating property at fixation of a toner. Further, components freed from a mold releasing agent cause electrification suppression in some cases.

JP-A Nos. 4-69666 and 9-258481 describe a method for solving these problems, providing the method of obtaining inflexibility of a binder resin by addition of a high-molecular component. In addition, JP-A Nos. 59-218460 and 59-218459 describe methods of improving the peelability at oil-less fixation by introducing a chemical cross-linking agent and, as a result, decreasing the thread-forming property at the temperature for toner fixation.

However, when the cross-linking agent component is simply added to a binder as described in JP-A Nos. 59-218460 and 59-218459, since the viscosity of the toner, or the aggregating force at melting becomes great and the inflexibility of the binder resin itself increases, temperature dependency at oil-less peeling and toner mounting amount dependency are improved to an extent, but it is difficult to obtain surface glossiness of a fixed image at the same time.

The bending resistance of a fixed image also becomes deficient. Further, when the molecular weight of the cross-linking agent is merely increased as described in JP-A No. 59-218460, the molecular weight between entanglement points is sure to increase, and the flexibility of the fixed image itself is slightly improved. Nonetheless, it is difficult to obtain suitable balance between the elasticity and the viscosity, and it is difficult to satisfy both of the temperature dependency and the toner mounting amount dependency of peeling at oil-less fixation, not to mention the glossiness of the fixed image surface.

In addition, when a low-temperature low-pressure energy saving-type fixing apparatus is used, or a high-speed copying machine or printer is used, it is fundamentally difficult to obtain a satisfactory fixed image.

JP-A No. 4-69664 describes a method of improving high temperature offset of a toner at fixation with fine polymer particles or fine inorganic particles. When afine inorganic particles are merely added to a toner, toughness at toner binder melting upon fixation is assuredly increased due to the filler effect of the particles, and such a toner exhibits the effect of preventing high temperature offset or improving the peelability. At the same time, the flowability of the melted toner is reduced, and low temperature offset and the glossiness of a fixed image can be deteriorated. Further, the bending resistance of a fixed image is reduced in some cases. In addition, depending on the amount of particles to be added, only the viscosity of the toner at melting is merely increased and, as a result, the peelability is deteriorated in certain cases.

However, in a one-component developer using magnetic metal particles as a colorant, since the specific gravity of the toner can definitely be increased in a melting kneading pulverizing method, which is a dry process, the coloring function and the electrifying function can be suitably controlled. Further, stable electrifiability and coloring property can be manifested at the same time, the system for controlling the toner concentration in the electrophotographic process can be simplified, and an extremely useful toner can be obtained. However, since the controllability of a structure such as a core/shell structure of a toner is deteriorated, there is a problem in flowability, and it is difficult to obtain a precise image.

Meanwhile, in order to solve these problems, new toners and processes are provided, such as an emulsion aggregation and coalescent method (heterogenous aggregating method), a suspension polymerization method, a solubility suspension granulation method, and a solubility emulsion aggregating coalescent method which are wet processes. However, since these wet processes produce a toner particle in an acidic or alkaline aqueous medium, when the fine magnetic metal particles are dispersed in these media, the surface property of the magnetic material itself is greatly changed by oxidation or reduction and, under acidity, the surface of the magnetic material oxidizes, the color changes to a reddish-brown color and, under the alkaline property, iron hydroxide particles are produced, and a change in the magnetism occurs and, therefore, the electrifiability is suppressed.

In addition, under the acidity, a dissolved magnetic particle ion is present in an aqueous medium and, in an emulsion aggregation and coalescent method, since ion balance in an aggregation system is disintegrated, it becomes difficult to control the aggregation rate; in a suspension polymerization system, since polymerization is suppressed, it is particularly difficult to control the particle diameter. Further, in a solubility suspension granulation method and a solubility emulsion aggregating coalescent method, it is difficult to obtain particle stability upon granulation or emulsification.

SUMMARY OF THE INVENTION

Accordingly, the objective of the present invention is to solve the aforementioned conventional problems and achieve the following effects. Namely, the object of the present invention is to provide a toner, for electrostatic charged image development, containing fine magnetic metal particles (hereinafter, referred to as "magnetic metal particles"), having good hue, a high degree of blackness, and excellent electrifiability and fixability. The present invention also provides a process for preparing such a toner, as well as an image forming method, an image forming apparatus and a toner cartridge.

The aforementioned goal is solved by the following means. That is:

the toner for electrostatic charged image development of the invention contains at least a binder resin, a mold releasing agent and fine magnetic metal particles (also referred to as "magnetic metal particles"), which have a solubility in a 1 mol/l aqueous $HNO_3$ solution at 50° C. of 500 mg/g·l or less.

The toner cartridge of the invention is a toner cartridge for accommodating at least a toner to be supplied to developing means provided in the image forming apparatus, wherein the toner contains at least a binder resin, a mold releasing agent and magnetic metal particles, and the solubility of the magnetic metal particles in a 1 mol/l aqueous $HNO_3$ solution at 50° C. is 500 mg/g·l or less.

The image forming method of the invention comprises at least an electrifying step of electrifying the surface of an image supporting member, an electrostatic latent image forming step of forming an electrostatic latent image corresponding to image information on the surface of the electrified image supporting member, a developing step of developing the electrostatic latent image formed on the surface of the image supporting member with a developer containing at least a toner to obtain a toner image, and a fixing step of fixing the toner image on the surface of a recording medium, wherein the toner contains at least a binding resin, a mold releasing agent and magnetic metal particles, and the solubility of the magnetic metal particles is 500 mg/g·l or smaller in a 1 mol/l aqueous $HNO_3$ solution at 50° C.

The image forming apparatus of the invention is an image forming apparatus comprising at least electrifying means for electrifying the surface of an image supporting member; electrostatic latent image forming means for forming an electrostatic latent image corresponding to image information on the surface of the electrified image supporting member; developing means for developing the electrostatic latent image formed on the surface of the image supporting member with a developer containing at least a toner to obtain a toner image; and fixing means for fixing the toner image on the surface of a recording medium, wherein the toner contains at least a binder resin, a mold releasing agent and magnetic metal particles, and the solubility of the magnetic metal particles is 500 mg/g·l or smaller in a 1 mol/l aqueous $HNO_3$ solution at 50° C.

A first process for preparing a toner for electrostatic charged image development of the invention is a process for preparing a toner for electrostatic charged image development which contains at least a binder resin, a mold releasing agent and a magnetic metal particles and in which the solubility of the magnetic metal particles in a 1 mol/l aqueous $HNO_3$ solution at 50° C. is 500 mg/g·l or less, which comprises: an aggregation step of mixing a resin particle dispersion in which at least fine resin particles (hereafter, referred to as "resin particles") of 1 $\mu$m or smaller are dispersed, a magnetic metal particle dispersion in which magnetic metal particles are dispersed, and a mold releasing agent particle dispersion in which mold releasing agent particles are dispersed, to form aggregated particles of resin particles, magnetic metal particles and mold releasing agent particles, and a fusion/coalescence step of heating the aggregated particles to a temperature equal to or greater than the glass transition point or melting point of the resin particles, so as to fuse and coalesce the particles.

A second process for preparing a toner for electrostatic charged image development of the invention is a process for preparing a toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or less, which comprises: applying a mechanical shearing force to a dispersion containing at least a polymerizable monomer, a polymerization initiator, a mold releasing agent and magnetic metal particles in the presence of an inorganic or organic dispersing agent, to suspend the dispersion, and applying thermal energy to polymerize the material while applying stirring shear, to obtain toner particles.

A third process for preparing the toner for electrostatic charged image development of the invention is a process for preparing a toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or less, which comprises: dispersing a polymerizable monomer, a polymerization initiator, a mold releasing agent and magnetic metal particles in a polymer solution obtained by pre-polymerizing a polymerizable monomer in advance so that a weight average molecular weight becomes 3000 to 15000, applying a mechanical shearing force to this dispersion in the presence of an inorganic or organic dispersing agent, to suspend the material, and applying thermal energy while applying stirring shear, to polymerize the material to obtain toner particles.

A fourth process for preparing the toner for electrostatic charged image development of the invention is a process for preparing a toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or less, which comprises: applying a mechanical shearing force to a solution in which a binder resin, a mold releasing agent and magnetic metal particles are dissolved in an organic solvent in the presence of an inorganic or organic dispersing agent, to suspend the solution, and performing desolvation to obtain toner particles.

A fifth process for preparing the toner for electrostatic charged image development of the invention is a process for preparing a toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or smaller, which comprises: a step of applying a mechanical shearing force to a solution in which a binder resin is dissolved in an organic solvent in the presence of an anionic surfactant, to emulsify and desolve the solution, applying a mechanical shearing force in the presence of an anionic surfactant to obtain a resin particles of at least 1 $\mu$m or smaller, and cooling the material to not more than 50° C. to prepare a resin particle dispersion solution, an aggregation step of mixing the resin particle dispersion solution, a magnetic metal particle dispersion in which magnetic metal particles are dispersed, and a mold releasing agent particle dispersion in which mold releasing agent particles are dispersed, to form aggregated particles of resin particles, magnetic metal particles and mold releasing agent particles, and a fusion/coalescence step of heating the aggregated particles to a temperature not lower than a glass transition point or a melting point of the resin particles to fuse and coalesce the particles.

Figure 1:
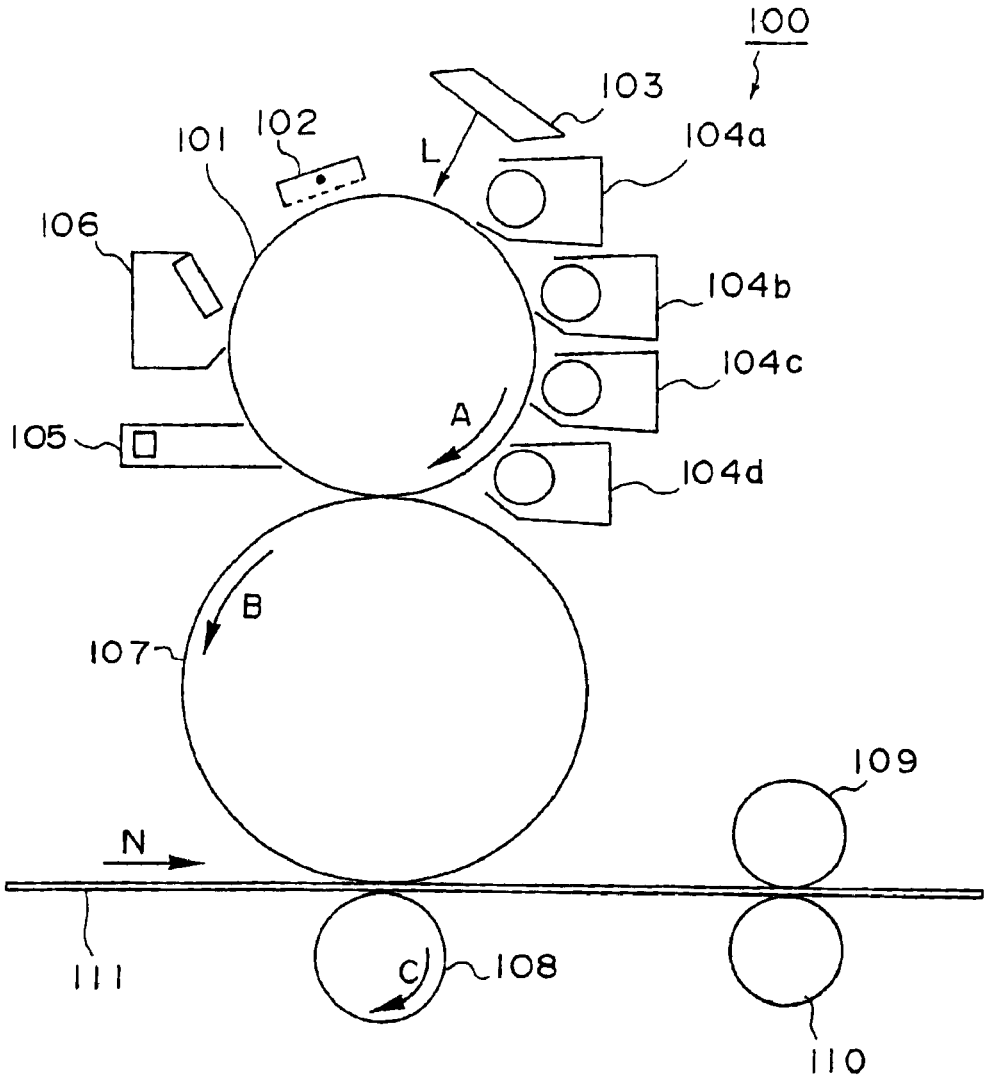
FIG. 1 is a schematic view illustrating one example of the image forming apparatus of the present invention.

DESCRIPTION OF THE INVENTION (Toner for Electrostatic Charged Image Development and Process for Preparing the Same)

The toner of the present invention is characterized in that it contains at least a binder resin, a mold releasing agent and magnetic metal particles, which have a solubility of 500 mg/g·l or less in a 1 mol/l aqueous $HNO_3$ solution at 50° C. In the aforementioned magnetic metal particles, for example, upon preparation such as awet process for producing toner particles in an acidic aqueous solvent or an alkaline aqueous solvent, oxidation or reduction does not easily occur, the surface property of the magnetic material itself does not change, and color tone change to a reddish-brown color due to oxidation, and unwanted occurrences such as changes in magnetism due to phenomena such as generation of iron hydroxide particles are suppressed. For this reason, the toner of the invention containing the aforementioned magnetic metal particles has better hue and a high degree of blackness and, thus, has excellent electrifiability and fixability.

Magenetic Metal Particles

The magnetic metal particles have a solubility of 500 mg/·l or less in a 1 mol/l aqueous $HNO_3$ solution at 50° C. and, since the toner is obtained in an aqueous layer, the aqueous layer moving property of themagnetic material, the solubility, and the oxidizability become excellent. This solubility is preferably 100 to 340 mg/g·l, and more preferably 150 to 270 mg/g·l.

When this solubility exceeds 500 mg/g·l, the ion balance upon formation of a toner particle is disintegrated, which not only lowers particle stability, but also makes the particle prone to oxidation or reduction. This changes the color tone to a reddish-brown color and sufficient degree of blackness is not obtained, causing, for example, a change in the magnetism due to generation of iron hydroxide particles.

On the other hand, it is not preferable for the solubility to be too low in a toner containing a binder resin having a polar group such as the aforementioned polymerized toner. This is due to the fact that the dispersibility of the magnetic metal particles in the toner is decreased and an aggregate composed of only fine particles is formed in the toner, which not only lowers the color developing property, but also deteriorates dielectric property of the toner, thereby damaging the electrifiability in certain cases. Here, the desired solubility can be obtained as follows: First, 10 g of magnetic metal particles are added to 0.1 L of a 1 mol/l aqueous nitric acid solution heated to 50° C., and the mixture is stirred for 1 hour, and then separated using a No. 5A filter. 10 g of this filtrate is placed in an evaporating dish, which was weighed precisely in advance to comform its mass W0, and heating and drying are performed at 130° C. for 1 hour. A mass W1 of the evaporating dish after drying is weighed precisely. Then, the amount of dissolved magnetic metal particles is obtained from the difference between W1 and W0.

Examples of the magnetic metal particles include substances which are magnetized in a magnetic field, for example, ferromagnetic powders (e.g., iron, cobalt, nickel), ferrite, magnetite and black titanium oxide. For adjusting the solubility to the aforementioned range, it is preferable that these magnetic metal particles are subjected to a surface modifying treatment such as hydrophobicizing treatment to form 1 or more covering layer(s) on their surfaces.

For example, when magnetic ferrite, magnetite or black titanium oxide are used as magnetic metal particles, it is preferable to subject the particles to acid-resistant or alkali-resistant treatment so as to form a surface-covering layer.

Specific examples of the covering layers derived from such acid resistant or alkali resistant treatment include a surface-covering layer obtained with a coupling agent; a surface-covering layer obtained with gold, platinum, carbon deposition, sputtering or the like; a surface-covering layer obtained with poly (sodium acrylate), poly (potassium methacrylate) or styrene acrylic acid copolymer.

It is particularly preferable that the covering layer contains at least one type of element selected from Si, Ti, Ca, P and Sr. This covering layer may be formed by adsorbing these elements onto the particle surface by deposition or sputtering, or may be formed on the particle surface by covering a resin having these elements dispersed therein.

It is preferable that the weight average film thickness of these covering layers be 10 to 200 nm. When the weight average film thickness is less than 10 nm, the covering is not uniform making the covering effect deficient, and the acid resistance or the alkali resistance deficient, thereby making it impossible to prevent dissolution out or denaturation. On the other hand, when the weight average film thickness exceeds 500 nm, it is not only costly but also difficult to obtain particle size distribution when covering. In particular, in order to adjust the solubility to the aforementioned range, it is preferable that these covering layers are formed so as to be highly dense.

Further, in order to obtain stable dispersibility in an aqueous medium, a compound having a $SO_3$ group and/or a COOH group is imparted to the surface of a covering layers of magnetic metal particles and it is preferable that the surfaces thereof are made to have a $SO^{3-}$ group and/or a $COO^-$ group as a polar group.

Examples of methods of imparting a compound having a $SO_3$ group and/or a COOH group to the surface of a covering layer include the method of adding 0.01 to 3% by mass sodium alkylbenzenesulfonate or a mixture containing this; or adding (meth)acrylic acid compound (e.g., sodium acrylate, sodium methacrylate, potassium methacrylate, etc.) to a magnetic metal particle dispersion. When this addition amount is 0.01% by mass or less, the dispersing effect is deficient, and there are cases when sufficient containment and aggregating properties can not be obtained. When this addition amount exceeds 3% by mass, it takes longer to sufficiently remove the compound when washing, thereby increasing costs.

Since it is advantageous that the polarity of a mold releasing agent is smaller than that of a binder resin, in terms of electrifiability and durability, it is preferable that the acid value of the magnetic metal particles with covering layers having a polar group thereon is 2.5 to 6.0 meq/mg-KOH. In addition, from the viewpoint of containment, it is preferable that the difference in the acid values of the magnetic metal particles and the binder resin is 0.5 to 6.0 meq/mg-KOH. It is even more preferable that the acid value of the magnetic metal particles is 3.0 to 4.5 meq/mg-KOH, and that the difference between the acid values of the magnetic metal particles and that of the binder resin is 1.5 to 4.0 meq/mg-KOH. Further preferably, the acid value of the magnetic metal particles is 3.0 to 3.7 meq/mg-KOH, and the difference between the acid value of the magnetic metal particles and the binder resin is 2.8 to 3.5 meq/mg-KOH.

Here, an acid value is obtained by, for example, KOH titration (neutralization titration). A 1 mol aqueous KOH solution, an aqueous binder resin solution or an aqueous mold releasing agent solution are prepared, and the amount of KOH titration until neutralization is obtained using methyl orange or the like as an indicator. In addition, the acid value is expressed as an equivalent by dividing the titration amount by the molecular weight of KOH, which is 56.

The mixture may contain magnetic metal particles that are shperical, octahedral, or cuboidal, or combinations of these. These magnetic metal particles can be used together with a coloring material such as carbon black.

An average particle diameter of a magnetic metal particle is preferably 50 to 250 nm, more preferably 80 to 220 nm, and further preferably 100 to 200 nm. When the particle diameter is smaller than 50 nm, particles re-aggregate after dispersing treatment and, as a result, large particles are formed, thereby lowering containment in certain cases. On the other hand, when the particle diameter is larger than 250 nm, the dispersing controllability upon formation of the toner particles decreases, making arbitrary control difficult in certain cases.

The amount of magnetic metal particles to be added is preferably 5 to 50% by mass, more preferably 30 to 50% by mass, and further preferably 40 to 50% by mass. When this addition amount is too small, the coloring property is reduced, which means that not only is an insufficient degree of blackness obtained, but also electrifiability becomes insufficient in certain cases. When this addition amount is too large, the dispersibility of the magnetic metal particle in a toner deteriorates, hence, not only is the color developing property reduced, but the dielectric property of the toner itself also deteriorates, which can damage electrifiability.

Binder Resin

Known resin materials can be used for the binder resin, and examples thereof include polymers of monomers such as styrenes such as styrene, parachrolostyrene, and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinylnitriles such as acrylonitrile, methacrylonitrile; vinyl ethers such as vinyl methyl ether, and vinyl isobutyl ether; vinyl ketones such as vinyl methyl ketone, vinyl ethyl ketone, and vinyl isopropenyl ketone; polyolefins such as ethylene, propylene, and butadiene; copolymers obtained by combing two or more of the above; and mixtures thereof.

Further, examples of usable binder resins include an epoxy resin, a polyester resin, a polyurethane resin, a polyamide resin, a cellulose resin, a polyether resin, and a non-vinyl fused resin, mixtures of these resins and the aforementioned vinyl type resins, and graft polymers obtained by polymerizing a vinyl type monomer in the presence of these resins.

When a binder resin is prepared using a vinyl type monomer, emulsion polymerization using an ionic surfactant can be performed to prepare a resin particle dispersion. On the other hand, when the binder resin is another resin, a resin particle dispersion can be prepared by dissolving the resin in an oily solvent which has relatively low solubility in water, dispersing this together with an ionic surfactant and a polymer electrolyte in water with a dispersing machine such as a homogenizer and, thereafter, heating or evacuating in order to evaporate the solvent.

The particle diameter of the thus obtained resin particle dispersion can be measured with device such as a laser diffraction particle size distribution measuring apparatus (LA-700: manufactured by Horiba, Ltd.).

In addition, it is also preferable that a crystalline resin be used as the main component of the binder resin. Here, the term "main component" refers to a primary component among components constituting the binder resin, specifically, a component constituting 50% by mass or more of the binder resin. In the present invention, the crystalline resin in the binder resin is preferably 70% by mass or larger, more preferably 90% by mass or larger, and it is particularly preferable that the crystalline resin constitutes 100% by mass of the binder resin. When the resin constituting the main component of a binder resin is not crystallizable, that is, amorphous, there are cases when it becomes difficult to retain the toner blocking resistance and image retainability while maintaining adequate low-temperature fixability.

The term "crystalline resin" refers to a resin not having a step-like change in the amount of heat absorption but having a clear endothermic peak in measurement of differential scanning calorimetry (DSC).

The crystalline resin is not particularly limited as long as it is a crystallizable resin. Examples of usable crystalline resins include a crystalline polyester resin and a crystalline vinyl type resin. The crystalline polyester is preferable from the viewpoint of fixability onto paper at fixation, electrifiability, and adjustment of the melting point to a preferable range. In addition, an aliphatic crystalline polyester resin having a suitable melting point is even more preferable.

Examples of crystalline vinyl type resins include vinyl type resins using (meth) acrylic acid ester of long chain alkyl or (meth)acrylic acid ester of long chain alkenyl. Examples of the (meth)acrylic acid ester include amyl (meth)acrylate, hexyl (meth)acrylate, heptyl (meth)acrylate, octyl (meth) acrylate, nonyl (meth)acrylate, decyl (meth)acrylate, undecyl (meth)acrylate, tridecyl (meth)acrylate, myristyl (meth) acrylate, cetyl (meth)acrylate, stearyl (meth)acrylate, oleyl (meth)acrylate, behenyl (meth)acrylate, and the like. In the present specification, the description of "(meth) acryl" means any of "acryl" and "(meth)acryl".

Meanwhile, the crystalline polyester resin is synthesized from an acid (dicarboxylic acid) component and an alcohol (diol) component. In the invention, the copolymer obtained by copolymerizing other components at a ratio of 50% by mass or less relative to the aforementioned crystalline polyester main chain is also the crystalline polyester.

The process for preparing the crystalline polyester resin is not particularly limited, and can be prepared with a general polyester polymerizing method in which an acid component and an alcohol component are reacted. In addition, examples of usable polyester polymerizing methods include a direct polycondensing method and an ester exchanging method, and these methods are applied depending on the kind of monomer.

The crystalline polyester resin can be prepared at a polymerization temperature between 180 and 230° C. In preparation of the crystalline polyester resin, the reaction system is evacuated if necessary, and a monomer is reacted while removing water and alcohol, which are produced upon condensation. When a monomer does not dissolve or is not compatible under a reaction temperature, it may be dissolved by adding a high boiling point solvent as a solubilizer. A polycondensation reaction is performed while distilling off the solubilizer. When a monomer having less compatibility is present in a copolymerization reaction, this monomer having less compatibility can be condensed in advance with an acid or an alcohol which is to be polycondensed with the monomer, after which this may be polycondensed with a main component.

Catalysts that can be used upon preparation of the crystalline polyester resin include alkali metal compounds such as sodium and lithium; alkaline earth metal compounds such as magnesium and calcium; metal compounds such as zinc, manganese, antimony, titanium, tin, zirconium, and germanium; phosphite compounds; phosphate compounds; and amine compounds. Examples of these catalysts include the following compounds:

Specific examples of the catalyst include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octylate, germanium oxide, triphenyl phosphite, tris(2,4-t-butylphenyl) phosphite, ethyltriphenyl phosphonium bromide, triethylamine, triphenylamine and the like.

The melting point of the crystalline resin is preferably 50 to 120° C., and more preferably 60 to 110° C. When the melting point is lower than 50° C., problems can arise in some cases in retainability of the toner, or the retainability of the toner image after fixation. On the other hand, when the melting point is higher than 120° C., there are cases when sufficient low-temperature fixation is not obtained when compared with conventional toners.

Here, the melting point of the crystalline resin is measured using a differential scanning calorimeter (DSC). The melting point of the crystalline resin can be obtained as a melting peak temperature of input-compensated differential scanning calorimetry shown in JIS K-7121 when measured from room temperature to 150° C. at a temperature rising rate of 10° C. per min. In addition, the crystalline resin exhibits multiplemelting peaks in certain cases and, in the present invention, the maximum peak is regarded as the melting point.

Mold Releasing Agent

As a mold releasing agent used in the toner of the invention, a substance having a main maximum peak, as measured with a ASTMD3418-8, in the range of 50 to 140° C. is preferable. When the main maximum peak is lower than 50° C., offset tends to occur at fixation. On the other hand, when the main maximum peak is higher than 140° C., the fixing temperature also increases and, since the smoothness of the image surface is insufficient, there are cases where the glossiness is damaged.

For measuring the main maximum peak, a device such as a DSC-7 manufactured by Perkin Elmer can be used. For correcting the temperature at a detecting portion of this apparatus, the melting points of indium and zinc are used. For correcting the amount of heat in this apparatus, the melting heat of indium is used. The main maximum peak of a sample is measured at a temperature rising rate of 10° C./min using an aluminium pan, and setting a vacant pan as a control.

The viscosity of a mold releasing agent at a temperature at fixation initiation (e.g., 180° C.) is preferably 15 mPa·s or less, more preferably 1 to 10 mPa·s, and further preferably 1.5 to 8 mPa·s. When this viscosity exceeds 15 mPa·s, the dissolution out at fixation is reduced, the peelability is deteriorated, and offset tends to occur.

A mold releasing agent is contained, preferably, at 5 to 30% by mass, more preferably 5 to 25% by mass, and further preferably 5 to 20% by mass. The content of this mold releasing agent is the content obtained from an area of an endothermic peak.

A mold releasing agent dispersion containing mold releasing agent particles can be prepared by dispersing a mold releasing agent together with a polymer electrolyte (e.g., ionic surfactant, polymer acid, polymer base, etc.) in water, heating the dispersion to the melting point or higher, and applying strong shear force with a homogenizer or a pressure discharge-type dispersing machine in order to turn the material into fine particles. The resulting mold releasing agent dispersion contains mold releasing agent particles having particle diameters of 1 $\mu$m or smaller. The particle diameter of the resulting mold releasing agent particle dispersion can be measured with, for example, a laser diffraction particle size distribution measuring apparatus (LA-700: manufactured by Horiba, Ltd.).

In terms of electrifiability and durability, it is preferable that the mold releasing agent has a polarity smaller than that of the binder resin particles. That is, it is preferable from the viewpoint of good containment that the acid value of a mold releasing agent is less than that of the binder resin by 0.5 meq/mg-KOH or more.

Here, the acid value in the present invention can be obtained, for example, by KOH titration (i.e., neutralization titration). A 1 mol aqueous KOH solution, an aqueous binding resin solution or an aqueous mold releasing agent solution is prepared, and the amount of KOH titration until neutralization is obtained using methyl orange or the like as an indicator. In addition, the acid value is expressed as an equivalent by dividing the titration amount by the molecular weight of KOH, which is 56.

Examples of the mold releasing agent include low-molecular polyolefins such as polyethylene, polypropylene, and polybutene; silicones having a softening point by heating: fatty acid amides such as oleic acid amide, erucic acid amide, ricinolic acid amide, and stearic acid amide; vegetable waxes such as carnauba wax, rice wax, candelilla wax, Japan wax, and jojoba oil; animal waxes such as beewax; mineral or petroleum waxes such as montan wax, ozokerite, ceresin, paraffin wax, microcrystalline wax, and Fischer Tropsch wax; and modifications thereof may also be used.

Other Materials

In the toner of the invention, a colorant may be used together with the aforementioned magnetic metal fine particle. Known colorants can be used. Examples of usable black pigments include carbon black, copper oxide, black titanium oxide, black iron hydroxide, manganese dioxide, aniline black, active carbon, non-magnetic ferrite, magnetic ferrite, and magnetite.

Alternatively, a dye may be used as the colorant. Examples of usable dyes include various dyes (e.g., nigrosin, etc.) such as a basic dye, an acidic dye, a dispersed dye, and a direct dye. In addition, dyes may be used alone or in admixture, or in a solid solution state.

These colorants are dispersed in an aqueous solution by known methods, preferably using devices such as a rotation shearing-type homogenizer, a media-type dispersing machine such as a ball mill, a sand mill, an attritor and the like, and a high pressure counter-collision dispersing machine.

Since a colorant such as carbon black is dispersed together with the magnetic metal particles in an aqueous system with the aforementioned homogenizer using a polarized surfactant, the colorant is selected in terms of its dispersibility in a toner. The colorant is added at 3 to 50 parts by mass relative to 100 parts by mass of the binder resin.

In order to improve and stabilize the electrifiability, the toner of the invention can contain an electrification controlling agent. The electrification controlling agent can be any of various electrification controlling agents normally used, such as a dye (e.g., quaternary ammonium salt compound, nigrosin type compound, dye comprising a complex of aluminium, iron, chromium) and a triphenylmethane type pigment can also be used. As the electrification controlling agent, materials that do not dissolve easily in water are suitable both for controlling the ionic strength, which influences the stability at aggregation or coalescence, and reducing waste water pollution.

In order to stabilize the electrifiability, fine inorganic particles (also referred to as "inorganic particles") can be added to the toner of the invention via a wet process. Examples of such inorganic particles include all those that are usually used as an external additive for the toner surface, such as silica, alumina, titania, calcium carbonate, magnesium carbonate and tricalcium phosphate. These inorganic particles can be used by dispersing with an ionic surfactant, a polymer acid or a polymer base.

In addition, for the purpose of imparting the flowability or improving the cleanability, inorganic particles (e.g. silica, alumina, titania, calcium carbonate etc.) or resin particles (vinyl type resin, polyester, silicone etc.) may be added to the toner of the invention. These particles are added to the surface by applying shear in the dry state of a toner, and as aids for flowing or cleaning.

Toner Properties

The volume average particle diameter of the toner of the invention is preferably 1 to 12 μm, more preferably 3 to 9 μm, and more preferably 3 to 8 μm. In addition, the number average particle diameter of the toner of the invention is preferably 1 to 10 μm, and more preferably 2 to 8 μm. When the particle diameter is too small, not only does the manufacturing property become unstable, but control of a containment structure also becomes difficult, and the electrifiability becomes insufficient, thereby lowering developability in certain cases. When the particle diameter is too large, the image resolution is reduced.

It is preferable that a volume average particle size distribution index GSDV of the toner of the invention is 1.30 or less. In addition, it is preferable that the ratio of a volume average particle diameter distribution index GSDV and a number average particle size distribution index GSDp (GSDv/GSDp) is 0.95 or greater.

When the volume distribution index GSDv exceeds 1.30, the resolution of an image is reduced in some cases. In addition, the ratio of a volume average particle diameter distribution index GSDv and a number average particle size distribution index GSDP (GSDv/GSDP) is less than 0.95, the electrifiability of the toner is reduced, and flight, fog and the like occur, thereby leading to image defects in some cases.

In the invention, the values of toner particle diameter the aforementioned volume average particle size distribution index GSDv, and the number average particle size distribution index GSDP were measured and calculated as follows: First, the particle size distribution of a toner measured using a measuring device such as a Coulter Counter TAII (manufactured by Nikkaki Bios Co., Ltd.)or a Multisizer II (also manufactured by Nikkaki Bios Co., Ltd.) is drawn as an accumulated distribution from a small diameter side, for a divided particle size range (channel), regarding a volume and a number of individual toner particles. Next, a cumulative particle diameter of 16% is defined as a volume average particle diameter D16v and a number average particle diameter D16p, and a cumulative particle diameter of 50% is defined as a volume average particle diameter D50v and a number average particle diameter D50p. Similarly, a cumulative particle diameter of 84% is defined as a volume average particle diameter D84v and a number average particle diameter D84p. Here, the volume average particle size distribution index (GSDv) is defined as $(D84v/D16v)^{1/2}$, and the number average particle size index (GSDP) is defined as $D84p/D16p)^{1/2}$. The volume average particle size distribution index (GSDv) and the number average particle size index (GSDP) can be calculated using these relational equations.

The absolute value of an electrification amount of the toner of the invention is preferably 15 to 60 μC/g, and more preferably 20 to 50 μC/g. When the electrification amount is less than 15 μC/g, background staining (i.e., fog) tends to occur and when the electrification amount exceeds 60 μC/g, image concentration tends to reduce easily.

In addition, the ratio of an electrification amount in summer (high temperature, high humidity) to the electrification amount in winter (low temperature, low humidity) in the toner of the invention is preferably 0.5 to 1.5, and more preferably 0.7 to 1.3. When the ratio is outside these ranges, the electrifiability of the toner tends to strongly depend on the environmental conditions, and the stability thereof is deficient, rendering the toner impractical.

The shape coefficient SF1 of the toner of the invention is preferably $110 \leqq SF1 \leqq 140$ from the viewpoint of the image forming property. This shape coefficient SF1 is calculated as an average of a shape coefficient (square of circumferential length/projected area), for example, by the following method. An optical microscopic image of a toner scattered on a glass slide is inputted into a Luzex microscope image analysis system through a video camera, the square of circumferential length/projected area $(ML^2/A)\times(\pi/4)\times100$ is calculated for 50 or more toners, and an average is obtained, whereby, the coefficient can be obtained.

In the toner of the present invention, the endothermic maximum obtained by differential thermo analysis is preferably 70 to 120° C., more preferably 75 to 110° C., and further preferably 75 to 103° C. from the viewpoint of the oil-less peelability and the manufacturing property of a toner.

In the toner of the invention, it is preferable that a storage modulus $G'_1$ of a toner at 180° C., obtained from measurement of the dynamic viscoelasticity at a frequency of 6.28 rad/s in a sine wave vibration method, is $1\times10^3$ to $1\times10^5$ Pa, and that the ratio of the storage modulus $G'_1$ of the toner, and a storage modulus $G'_2$ (Pa) of a toner at 180° C. obtained from measurement of the dynamic viscoelasticity at a frequency of 62.8 rad/s in a sine wave vibration method $(G'_2/G'_1)$ is 0.5 to 2.5. In addition, more preferably, a storage modulus $G'_1$ of a toner is $1.7\times10^3$ to $9.8\times10^4$ Pa, and the $(G'_2/G'_1)$ ratio is 1.0 to 2.0. Further preferably, a storage modulus $G'_1$ of a toner is $2.0\times10^3$ to $6.0\times10^5$ Pa, and the $(G'_2/G'_1)$ ratio is 1.1 to 1.8.

In addition, when a crystalline binder resin is used as the binder resin, it is preferable that a storage modulus $G'_1$ of a toner at 180° C. obtained from measurement of the dynamic viscoelasticity at a frequency of 6.28 rad/s in a sine wave vibration method is $1\times10$ to $5\times10^4$ Pa, and that the ratio of a storage modulus $G'_1$ of the toner, and a storage modulus $G'_2$ (Pa) of a toner at 180° C. obtained from measurement of the dynamic viscoelasticity at a frequency of 62.8 rad/s in a sine vibration method $(G'_2/G'_1)$ is 1.0 to 7.0. In addition, more preferably, a storage modulus $G'_1$ of a toner is $5\times10^2$ to $9.7\times10^4$ Pa, and the $(G'_2/G'_1)$ ratio is 1.0 to 6.8. More preferably, a storage modulus $G'_1$ of a toner is $1.5\times10^3$ to $6.0\times10^4$ Pa, and the $(G'_2/G'_1)$ ratio is 1.1 to 6.5.

An example of a device used for measuring the dynamic viscoelasticity to obtain this storage modulus of a toner is the ARES measuring apparatus manufactured by Rheometric Scientific. In measurement of the dynamic viscoelasticity, usually, the toner is molded into a tablet, set on a parallel plate having a diameter of 25 mm, the thickness of the sample is adjusted to 20 mm, the normal force is made to be 0, and a sine wave vibration is provided at 6.28 rad/sec and 62.8 rad/s. Measurement is initiated at 160° C. in order to do away with response error distortion at measurement initiation, and continued to 190° C., and a storage modulus G' measured and calculated at 180° C. is used.

This temperature is adjusted by controlling the temperature in the measurement system using liquefied nitrogen. In order to obtain precise measurements, it is preferable that the interval between measurement times is 30 seconds, and that the degree of accuracy of temperature adjustment after measurement initiation is ±1.0° C. or less. In addition, during measurement, adjustment is appropriately performed so that the distortion amount at the temperature measuring is properly maintained, and a properly measured value is obtained.

Generally, the dynamic elasticity and viscosity of a toner depend on the frequency during measurement of the dynamic viscoelasticity. When the frequency is high, contribution of the presence of not only the binder resin component constituting a toner but also of internal additives such as coloring materials and magnetic metal particles in a toner for elasticity becomes high, and there is a tendency of hardening. On the other hand, when the frequency is low, this contribution is reduced and, as a result, soft behavior is exhibited, thereby making the measured storage modulus small.

Generally, as the temperature rises, the state of the polymer material such as a toner changes from the motion state of a molecule chain to a glass region, a transition region, a rubber upper region and a flowing region. A glass region is the state where motion of a main chain of a polymer is frozen at a temperature equal to or less than the glass transition temperature (Tg), but as the temperature rises and the motion of the molecules increases, the material is gradually softened from the glass state and finally, the flowing state is exhibited.

These properties are influenced by the measuring frequency as described above, and the magnitude thereof is influenced also by the composition of the toner, that is, the thickness (volume) of the vicinity of the surface composed only of a binder resin; and the amount, position, and state of the toner present, that is, the dispersed state and affinity with a binder resin, of an internal additive for the toner.

In particular, in the toner of the present invention, formation of a core shell structure during production of the toner particles, differences in the presence state of a colorant, the magnetic particles or the mold releasing agent particle in the interior of the toner particles influence fixation and electrifiability. This difference is detected as a difference in responsiveness when the frequency for the dynamic viscoelasticity is changed.

For this reason, in the toner of the invention, it is preferable that a storage modulus $G'_1$ and a storage modulus ratio $(G'_2/G'_1)$ are adjusted to the aforementioned ranges because a better image can be formed, thus improving the dispersion condition of the internal additive inside the toner.

When this storage modulus G' is smaller than $1\times10^3$ Pa, the thread-forming property at melting of the toner is high, and not only is the oil-less peelability reduced, but also high temperature offset can worsen. On the other hand, when the storage modulus is greater than $1\times10^5$ Pa, since the elasticity is high and hard, no thread-forming property is exhibited, the hot offset and the oil-less peelability improve, but the adherability to materials such as paper decreases, i.e., the fixability is reduced in certain cases.

In addition, when the storage modulus ratio $(G'_2/G'_1)$ is smaller than 0.5, it indicates that dispersion of the internal additive inside the toner is not uniform, and sufficient structural control is not performed, and the uniformity between color developing particles and electrifying particles is reduced, which can causeflight. On the other hand, when the storage modulus ratio $(G'_2/G'_1)$ is greater than 2.5, the dispersibility is better, but the shell structure is not sufficiently formed in some cases, and although the fixability and the peelability are better, the electrifiability and the flowability tend to deteriorate.

In addition, when a crystalline resin is used as the binder resin, it is preferable that the toner has a melting point in the range of a temperature region of 50 to 120° C. (preferably, 70 to 100° C.). Since the viscosity of a crystalline resin rapidly reduces with a melting point being a border, and since it is stored at a temperature not lower than a melting point, it aggregates, causing blocking. Therefore, it is preferable that the melting point of a toner containing the aforementioned crystalline resin as a main component of the binder resin is a temperature higher than an exposure temperature at storage or at use, that is, 50° C. or higher. On the other hand, when the melting point is higher than 120° C., there are cases when it becomes difficult to achieve a low temperature fixation.

Here, the melting point of a toner can be obtained as a melting peak temperature in input compensated differential scanning calorimetry shown in JIS K-7121. Since a crystalline resin exhibiting a plurality of melting peaks in some cases is contained as the main component, or wax is contained in some cases, the toner can exhibit a plurality of melting peaks. In the present invention, the maximum peak is regarded as the melting point.

In the toner of the invention, in order to enable fixation at a low temperature of about 100° C., a storage modulus at an angular frequency of 1 rad/s and 120° C. is preferably $1\times10^5$ Pa or smaller, and more preferably $9.6\times10^4$ Pa or smaller.

In addition, in the toner of the present invention, when a crystalline resin is used as the binder resin, a storage modulus at an angular frequency of 6.28 rad/s and 120° C. is preferably $1\times10^5$ Pa or smaller, and more preferably 50 to $1\times10^5$ Pa.

Here, for measuring the storage modulus at an angular frequency of 1 rad/s and 120° C., a device such as a rotation flat plate Rheometer (RDA2RHIO system Ver.4.3.2, manufactured by Rheometric Scientific FE) is used. Measurement is performed, for example, by setting a sample in a sample holder, and measuring at a temperature rising rate of 1° C./min, a frequency of 1 rad/s, a distortion of 20% or smaller, and a detection torque in the range of a measurement guaranteed value. If necessary, measurement is performed by using an 8 mm or 20 mm sample holder.

It is preferable that the toner of the invention has a temperature such interval that variation in the storage modulus value at an angular frequency of 1 rad/s and 120° C. due to temperature change is 3 order or larger in a temperature range of 10° C. (temperature interval in which, when the temperature is raised by 10° C., the value of the storage modulus changes to 1/1000 or less). When the value of the storage modulus at an angular frequency of 1 rad/s and 120°

C. does not have the aforementioned temperature interval, the fixing temperature becomes high and, as a result, reduction in energy consumption at the fixing step becomes insufficient in some cases.

It is preferable that the toner of the invention has a melt viscosity of 100 Pa·s or higher at 120° C. in order to obtain better offset resistance. In addition, also in the case when a crystalline resin is used as a binder resin, it is preferable that the melt viscosity is 100 Pa·s or higher at 120° C.

By satisfying the properties of respective toners as explained above, a one-component or tow-component toner for electrostatic charged image development can be obtained which, even in a high-speed process, exhibits excellent electrifiability, has minimal difference in colors of electrification and, in oil-less fixation, does not exhibit fluctuation of peelability due to temperature. Further, a component can be obtained that maintains better glossiness, has excellent fixation properties such as fixed image adherability to a fixing sheet and peelability of a sheet to be fixed thereon, as well as excellent hot offset resistance, and fixed image bending durability and glossiness.

Preparation of Toner

The toner of the invention is ideally prepared by a wet process such as an emulsion aggregation and coalescent method, a suspension polymerization method, a solubility suspension granulation method, a solubility suspension method, and a solubility emulsion aggregating coalescent method. A wet process is a method of producing toner particles in an acidic or alkaline aqueous medium. By using the aforementioned magnetic metal particles, for example, in an emulsion aggregation and coalescent method, disintegration of ion balance in the aggregation system is suppressed, and control of the aggregation rate becomes easy. In addition, by using the aforementioned magnetic metal particles in a suspension polymerization method, polymerization inhibition is suppressed and, in particular, control of particle diameter becomes easy. Further, in a solubility suspension granulation method or a solubility emulsion aggregating coalescent method, it becomes possible to stabilize the particles upon granulation and emulsification.

An emulsion aggregation and coalescent method is a process having an aggregation step of mixing a fine resin particle dispersion in which at least fine resin particles of 1 μm or smaller are dispersed (also referred to as "resin particle dispersion" and "resin particles"), a magnetic metal particle dispersion in which magnetic metal particles are dispersed, and a mold releasing agent particle dispersion in which mold releasing agent particles are dispersed, to form aggregated particles of resin particles, magnetic metal particles, and mold releasing agent particles; and a fusion/coalescence step of heating the aggregated particles to a temperature of not lower than the glass transition point of the resin particles, in order to fuse and coalesce the particles.

An emulsion aggregation and coalescent method is, specifically, a method of obtaining toner particles as follows: first, a resin dispersion is used in which resin particles generally prepared by emulsion polymerization are dispersed with an ionic surfactant, and a magnetic metal particle dispersion in which particles are dispersed with an ionic surfactant having reverse polarity are mixed therein to cause heterogenous aggregation. To this are added resin particles, to adhere and aggregate the particles surfaces, whereby, aggregated particles having toner diameters are formed. Thereafter, this is heated to the glass transition point or melting point of the resin or higher in order to fuse and coalesce the aggregated material, then washed and dried to obtain the toner particles.

Further, this emulsion aggregation and coalescent method may be performed by comprehensive mixing and aggregation. Alternatively, this emulsion aggregation and coalescent method may be performed as follows: First, balance between the amounts of ionic dispersing agents having their respective polarities is shifted in advance at an early stage in the aggregation step, and the ionic dispersing agent is ionically neutralized using, for example, a polymer of at least one type of metal salt. And, a matrix aggregation at a first stage is formed and stabilized at the glass transition point or melting point or lower and, at a second stage, a particle dispersion treated, with a dispersing agent having such a polarity and amount so that a shift in balance is compensated, is added. At this point, if necessary, the material is slightly heated to the glass transition point or melting point, or lower, of the resin contained in the matrix or additional particles, and may be stabilized at a higher temperature. By heating to the glass transition point or melting point or higher, the particles added at the second stage of aggregation formation are coalesced while being adhered to the surface of the matrix aggregated particles. Further, this aggregation step procedure may be repeated multiple times.

In the aggregation step, it is ideal that a polymer of at least one kind of metal salt added when mixing the respective dispersions is a polymer of a tetra-valent aluminum salt, or a mixture of a polymer of a tetra-valent aluminium salt and a polymer of tri-valent aluminium salt. Examples of such polymers include inorganic metal salts (e.g., calcium nitrate, etc.), and the polymers of inorganic metal salts (e.g., poly (aluminium chloride), etc.). In addition, it is ideal that this metal salt polymer is added at a concentration of 0.11 to 0.25% by mass.

It is ideal that theaggregation step comprises a first aggregation step of mixing a resin particle dispersion in which at least first resin particles having particle diameters of 1 μm or smaller aredispersed, a magnetic metal particle dispersion in which magnetic metal particles are dispersed, and a mold releasing agent particle dispersion in which mold releasing agent particles are dispersed, to form core aggregated particles containing the first resin particles, the magnetic metal particles and the mold releasing agent particles; and a second aggregation step of forming a shell layer containing second resin particles on the surfaces of the core aggregated particles to obtain core/shell aggregated particles.

In the first aggregation step, first, a resin particle dispersion, a magnetic metal particle dispersion and a mold releasing agent particle dispersion are prepared. The resin particle dispersion is prepared by dispersing first resin particles prepared by emulsion polymerization in a solvent using an ionic surfactant. The colorant particle dispersion is prepared by dispersing colorant particles having the desired color such as blue, red, and yellow in a solvent using an ionic surfactant having the opposite polarity to that of the ionic surfactant used for preparing the resin particle dispersion. In addition, the mold releasing agent particle dispersion is prepared by dispersing a mold releasing agent together with an ionic surfactant and a polymer electrolyte such as a polymer acid and a polymer base in water, and heating to a melting point or higher and, at the same time, applying strong shear with a homogenizer or a pressure discharge-type dispersing machine to finely-divide the material.

Then, the resin particle dispersion, the colorant particle dispersion and the mold releasing agent particle dispersion are mixed with a hetero-aggregate, first resin particles, colorant particles and mold releasing agent particles, to form aggregated particles (i.e., core aggregated particles) containing the first resin particles, the colorant particles and the mold releasing agent particles, having diameters substantially near the desired toner diameter.

In the second aggregation step, second resin particles are adhered to the surface of the core aggregated particles obtained in the first aggregation step using a resin particle dispersion containing second resin particles. In this fashion, a covering layer (i.e., shell layer) of a desired sickness is formed, and aggregated particles (i.e., core/shell aggregated particles) having a core/shell structure in which a shell layer is formed on the particle surfaces thereof. The second resin particles used upon this may be the same as or different from the first resin particles.

In addition, the particle diameters of the first resin particles, the second resin particles, the magnetic metal particles, and the mold releasing agent particles, which are used in the first and second aggregation steps, are preferably 1 $\mu$m or smaller, and more preferably in the range of 100 to 300 nm in order to facilitate adjustment of toner diameter and particle size distribution to the desired value.

In the first aggregation step, balance between amounts of two polar ionic surfactants (dispersing agents) contained in a resin particle dispersion or a magnetic metal particle dispersion may be shifted in advance. For example, this is ionically neutralized using an inorganic metal salt (e.g., calcium nitrate, etc.), or a polymer of an inorganic metal salt (e.g., poly (aluminium chloride) etc.), and may be heated to the glass transition temperature of the first resin particles, or lower, to prepare core aggregated particles.

In this case, in the second aggregation step, the resin particle dispersion is treated with a dispersing agent at a polarity and amount such that the shift in balance between the two polar dispersing agents as described above is compensated. Further, this resin particle dispersion can be added to a solution containing core aggregated particles to prepare core/shell aggregated particles. When doing this, if it is further necessary, the material may be slightly heated at a temperature less than or equal to the glass transition temperature of the core aggregated particles or the second resin particles used in the second aggregation step.

In addition, the first and second aggregation steps may be repeated multiple times.

Next, in a fusion/coalescence step, the core/shell aggregated particles obtained via the aggregation step (i.e., second aggregation step) are heated to a temperature greater thsn or equal to the glass transition temperature of the first or second resin particles contained in these core/shell aggregated particles in a solvent (when two or more kinds of resins are used, the glass transition temperature of the resin having the highest glass transition temperature), in order to fuse and coalesce and obtain a toner.

A suspension polymerization method is a process for obtaining toner particles by suspending a dispersion containing at least a polymerizable monomer, a polymerization initiator, a mold releasing agent and magnetic metal particles in the presence of an inorganic or organic dispersing agent by applying a mechanical shearing force, and applying thermal energy while applying stirring shear, to polymerize the material.

A suspension polymerization method is, specifically, a process for obtaining toner particles as follows: First, a polymerizable monomer (e.g., styrene, acrylic acid ester, acrylic acid, etc.) is dissolved, the solution is heated to 55° C. in the presence of an inert gas to completely dissolve a mold releasing agent, and a polymerization initiator (e.g., azobisisobutyl acrylate etc.) is added thereto. Then, this is added to a water dispersion of an inorganic dispersing agent (e.g., calcium phosphate, etc.) pre-heated to 60° C., and the material is suspension-granulated by applying mechanical shear with a homogenizer (e.g., TK homomixer, etc.), in order to obtain a dispersion. This is heated to the temperature of a polymerization initiator at 10 hours so as to react in 6 hours. After completion of reaction and cooling to a normal temperature, an acid such as hydrochloric acid is added to dissolve and remove the dispersing agent component. Thereafter, this is washed with sufficiently pure water and, when the pH of the filtrate becomes neutral, solid-liquid separation is performed using a filtering material such as a No 5A filter, in order to obtain toner particles.

A solubility suspension granulation method is a process for obtaining a toner particle by dispersing a polymerizable monomer, a polymerization initiator, a mold releasing agent and magnetic metal particles in a polymer solution in which a polymerizable monomer is pre-polymerized to a weight average molecular weight of 3,000 to 15,000 in advance, suspending this dispersion in the presence of an inorganic or organic dispersing agent by applying a mechanical shearing force, and applying thermal energy to polymerize the material while applying stirring shear.

Specifically, the solubility suspension granulation method is a process for obtaining a toner particle as follows:

First, a polymerizable monomer is pre-polymerized in advance to prepare a solution of a polymer having Mw obtained from GPC measurement of 3,000 to 15,000. Thereafter, magnetic metal particles, a mold releasing agent, a colorant, a polymerizable monomer and a polymerization initiator are added to the polymer solution. This polymer solution is suspended in the presence of an inorganic or organic dispersing agent while applying a mechanical shearing force, and thermal energy is applied while applying stirring shear to obtain a polymer particle, in order to obtain a toner particle. In this process, although the process is basically the same as the aforementioned suspension granulation, by adjusting the Mw of a pre-polymer to 3,000 to 15,000, not only is a viscosity suitable for fixation and granulation obtained, but also a weight average molecular weight Mw of the produced toner can be controlled without requiring a chain transferring agent.

A solubility suspension method is a process for obtaining a toner particle by suspending a solution in which a binder resin, a mold releasing agent and magnetic metal particles are dissolved in an organic solvent, in the presence of an inorganic or organic dispersing agent by applying a mechanical sharing force, followed by desolvation.

Specifically, the solubility suspension method is a process for obtaining a toner particle as follows: First, binder resin components, magnetic metal particles and a mold releasing agent are dissolved once in an organic solvent (e.g., ethyl acetate, etc.). Then, the solution is dispersed in a solvent which do not dissolve them (e.g., an aqueous solvent) together with inorganic particles such as calcium phosphate, and a dispersing agent such as polyvinyl alcohol and poly (sodium acrylate)), and the solution is dispersed by applying a mechanical shearing force with a homogenizer (e.g., TK homomixer, etc.). Next, this is added to a 1M hydrochloric acid to dissolve and remove the dispersing agent component, and solid-liquid separation is performed with Nutsche using a filter. Thereafter, the remaining solvent component in the particles is distilled off to obtain thetoner particles.

A solubility emulsion aggregating coalescent method is a process having a step of preparing a resin particle dispersion solution by emulsifying a solution in which a binder resin is dissolved in an organic solvent in the presence of an anionic surfactant while applying mechanical shearing force thereto, to perform desolvation, and applying a mechanical shearing force in the presence of an anionic surfactant to obtain a resin particles of at least 1 μm or smaller, followed by cooling to 50° C. or lower, an aggregation step of mixing the resin particle dispersions, a magnetic metal particle dispersion in which magnetic metal particles are dispersed, and a mold releasing agent particle dispersion in which mold releasing agent particles are dispersed, to form aggregated particles of resin particles, magnetic metal particles and mold releasing agent particles; and a fusion/coalescence step of heating the aggregated particles to a temperature equal to or greater than the glass transition point or melting point of the resin particles in order to fuse and coalesce the particles.

Specifically, the solubility emulsion aggregating coalescent method is a process for obtaining toner particles as follows: First, a binder resin component is dissolved in a solvent that dissolves the component (e.g., ethyl acetate). Thereafter, this is emulsified with a mechanical shearing force with a homogenizer (e.g., TK homomixer, etc.) and an interface active force with an ionic surfactant (e.g., sodium alkylbenzenesulfonate, etc.) in the presence of an ionic surfactant, to obtain resin particles. Next, the remaining solvent is distilled off by distillation under reduced pressure to obtain a resin particle dispersion. Thereafter, the same procedures as those for the aforementioned emulsion aggregation and coalescent method afford toner particles.

Examples of a surfactant used in emulsion polymerization, suspension polymerization, suspension emulsification, suspension granulation, pigment dispersion, magnetic metal particle dispersion, resin particle dispersion, mold releasing agent dispersion, aggregation or stabilization thereof in the aforementioned processes include anionic surfactants such as sulfate salt type, alkylbenzensulfonate salt type, phosphate ester type, and soap type; as well as cationic surfactants such as amine salt type, and quaternary ammonium salt type. Alternatively, it is effective to use nonionic surfactants such as polyethylene glycol type, alkylphenol ethylene oxide adduct type, and polyhydric alcohol type together with these surfactants. Further, as a polymer dispersing agent, polyvinyl alcohol, poly(sodium acrylate), poly(potassium acrylate), poly(sodium methacrylate) and poly(potassium methacrylate) can be applied.

In addition, as the means for dispersion, common means such as a rotation shearing-type homogenizer, or a media-having ball mill, sand mill and dino mill can be used.

In any of these processes, after particle formation, a dispersing agent is removed with an aqueous solution of a strong acid such as hydrochloric acid, sulfuric acid, and nitric acid, rinsed with ion-exchanged water until the filtrate becomes neutral, after which a washing step, a solid liquid separation step, and a drying step are arbitrarily performed to obtain the desired toner. The solid-liquid separation step is not particularly limited, but from the viewpoint of productivity, methods such as suction filtration and pressure filtration are preferably used. Further, the drying step is not particularly limited, but from the viewpoint of productivity, lyophilization, flush jet drying, flowing drying, vibration type flowing drying and the like are preferably used.

(Image Forming Method and Image Forming Apparatus)

Next, the image forming method and image forming apparatus using the toner of the present invention will be explained.

The image forming method comprises at least an electrifying step of electrifying the surface of an image supporting member; an electrostatic latent image forming step of forming an electrostatic latent image corresponding to image information on the surface of the electrified image supporting member; a developing step of developing the electrostatic latent image formed on the surface of the image supporting member with a developer containing at least a toner to obtain a toner image; and a fixing step of fixing the toner image on the surface of a recording medium, utilizing the aforementioned toner.

Since the image forming method of the invention uses the present toner, which has excellent peelability at fixation and shape controllability at the toner preparation stage, upon fixation, the peelability between the toner image and the contacting member is excellent, and the occurrence of problems such as toner flight at development, image quality reduction after fixation can be prevented.

The image forming method of the invention is not particularly limited as longas it includes at least an electrifying step, an electrostatic latent image forming step, a developing step and a fixing step, and further, it may include other steps. Examples of other steps that may be included are, after the developing step, a transferring step of transferring a toner image formed on the surface of an image supporting member onto a transfer receiving material.

Similarly, the present image forming apparatus comprises at least an electrifying means for electrifying the surface of the image supporting member; electrostatic latent image forming means for forming the electrostatic latent image corresponding to image information on the surface of the electrified image supporting member; developing means for developing the electrostatic latent image formed on the surface of the image supporting member with a developer containing at least a toner to obtain a toner image; and fixing means for fixing the toner image on the surface of a recording medium, which utilizes the aforementioned toner.

Since the image forming apparatus of the invention can perform image formation using the present toner, which hasexcellent peelability at fixation and shape controllability at toner preparation, upon fixation, the peelability between the toner image and the contacting member is excellent, and occurrence of problems such as toner flight at development, image quality reduction after fixation can be prevented.

The image forming apparatus of the invention is not particularly limited as long as it includes at least an electrifying means, an electrostatic latent image forming means, a developing means and a fixing means, but it may include other means as well. Examples of other means that may be included are transferring means for, after developing, transferring a toner image formed on the surface of an image supporting member onto a transfer receiving material.

Next, the image forming method of the invention using the image forming apparatus of the invention will be explained in detail below, however, the invention is not limited to these embodiments.

FIG. 1 is a schematic view showing one example of the image forming apparatus of the invention. In FIG. 1, an image forming apparatus 100 comprises an image supporting member 101, an electrifier 102, a writing apparatus for forming an electrostatic image 103, developing devices 104*a*, 104*b*, 104*c*, 104*d* for accommodating developers of respective colors of black (K), yellow (Y), magenta (M), cyan (C), a destaticizing lamp 105, a cleaning apparatus 106, an intermediate transfer receiving material 107 and a transferring roll 108. The toner of the invention is contained in a developer accommodated in the developing device 104*a*.

At the periphery of the image supporting member 101, there are disposed, in an order along a rotational direction (direction of arrow A) of the image supporting member 101, a non-contact type electrifier 102 for uniformly electrifying the surface of the image supporting member 101; a writing apparatus 103 for forming an electrostatic latent image corresponding to image information on the surface of the image supporting member 101 by irradiating the surface of the image supporting member 101 with the scanning exposing light shown by an arrow L; developing devices 104*a*, 104*b*, 104*c*, 104*d* for supplying toners of their respective colors to the electric latent image, a drum-like intermediate transfer receiving material 107 which abuts against the surface of the image supporting member 101 and can follow-up rotate in an arrow B direction accompanied with rotation of the image supporting member 101 in an arrow A direction; a destaticizing lamp 105 for destaticizing the surface of the image supporting member 101; and a cleaning apparatus 106 abutting against the surface of the image supporting member 101.

In addition, a transferring roll 108, which can control abutting/non-abutting, is disposed on the surface of an intermediate transfer receiving material 107 on the opposite side of the image supporting member 101 relative to the intermediate transfer receiving material 107 and, upon abutting, the transferring roll 108 can follow-up rotate in an arrow C direction accompanied with rotation of the intermediate transfer receiving material 107 in an arrow B direction.

A recording medium 111, which is conveyed by a conveying means (not shown) from an opposite side to an arrow N direction to an arrow N direction, can penetrate between the intermediate transfer receiving material 107 and the transferring roll 108. On the arrow N direction side of the intermediate transfer receiving material 107, a fixing roll 109 housing a heating source (not shown) is disposed and, on the arrow N direction side of the transferring roll 108, a pushing roll 110 is disposed, and the fixing roll 109 and the pushing roll 110 are contacted by pressure, forming a pressure contacting part (nip part). In addition, the recording medium 111, which has passed between the intermediate transfer receiving material 107 and the transferring roll 108, can penetrate through this pressure contacting part in an arrow N direction.

Since the image forming apparatus of the invention uses the toner of the invention, which has the above-described excellent effects, unlike in conventional apparatuses, the surface of the present fixing roll 109 does not have to be covered with a low-surface energy film such as a fluorocarbon resin film. The surface of the fixing roll 109 may be exposed due to the fact that the core material is, for example, a SUS material or an Al material.

Next, image formation using the image forming apparatus 100 will be explained. First, accompanied with rotation of the image supporting member 101 in an arrow A direction, the surface of the image supporting member 101 is uniformly electrified with the non-contact electrifier 102, an electrostatic latent image corresponding to image information of each color is formed on the surface of the image supporting member 101 uniformly electrified with a writing apparatus 103, and the toner of the invention is supplied to the surface of the image supporting member 101 on which this electrostatic latent image is formed, from a developing device 104*g*, corresponding to color information of the electrostatic latent image, to form a toner image.

Next, the toner image formed on the surface of the image supporting member 101 is transferred onto the surface of the intermediate transfer receiving material 107 at the contacting part between the image supporting member 101 and the intermediate transfer receiving material 107, by applying a voltage between the image supporting member 101 and the intermediate transfer receiving material 107 with an electric source (not shown).

The surface of the image supporting member 101 after transfer of the toner image onto the intermediate transfer receiving material 107 is destaticized by irradiating light from a destaticizing lamp 105, and any remaining toner found on the aforementioned surface is removed with the cleaning blade of a cleaning apparatus 106.

By repeating the aforementioned steps per color, toner images of the respective colors corresponding to image information are laminated on the surface of the intermediate transfer receiving material 107.

At the aforementioned steps, the transferring roll 108 is in a state where it does not abut against the intermediate transfer receiving material 107, and is abutted against the intermediate transfer receiving material 107 at transferring onto a recording medium 111 after toner images of all colors are laminated on the surface of the intermediate transfer receiving material 107.

A toner image thus laminated on the surface of the intermediate transfer receiving material 107 is moved to a contacting part between the intermediate transfer receiving material 107 and the transferring roll 108, accompanied with rotation of the intermediate transfer receiving material 107 in an arrow B direction. At this time, the recording medium 111 penetrates through this contacting part with a paper conveying roll (not shown) in an arrow N direction, and toner images laminated on the surface of the intermediate transfer receiving material 107 are transferred as a whole onto the surface of the recording medium 111 at the contacting part, by voltage applied between the intermediate transfer receiving material 107 and the transferring roll 108.

The recording medium 111 having the surface on which a toner image is thus transferred is conveyed to a nip part between the fixing roll 109 and the pushing roll 110 and, while passing the nip part, is heated with the fixing roll 109 whose surface is heated with a built-in heating source (not shown). At this time, a toner image is fixed on the surface of the recording medium 111, and an image is formed.

Figure 2:
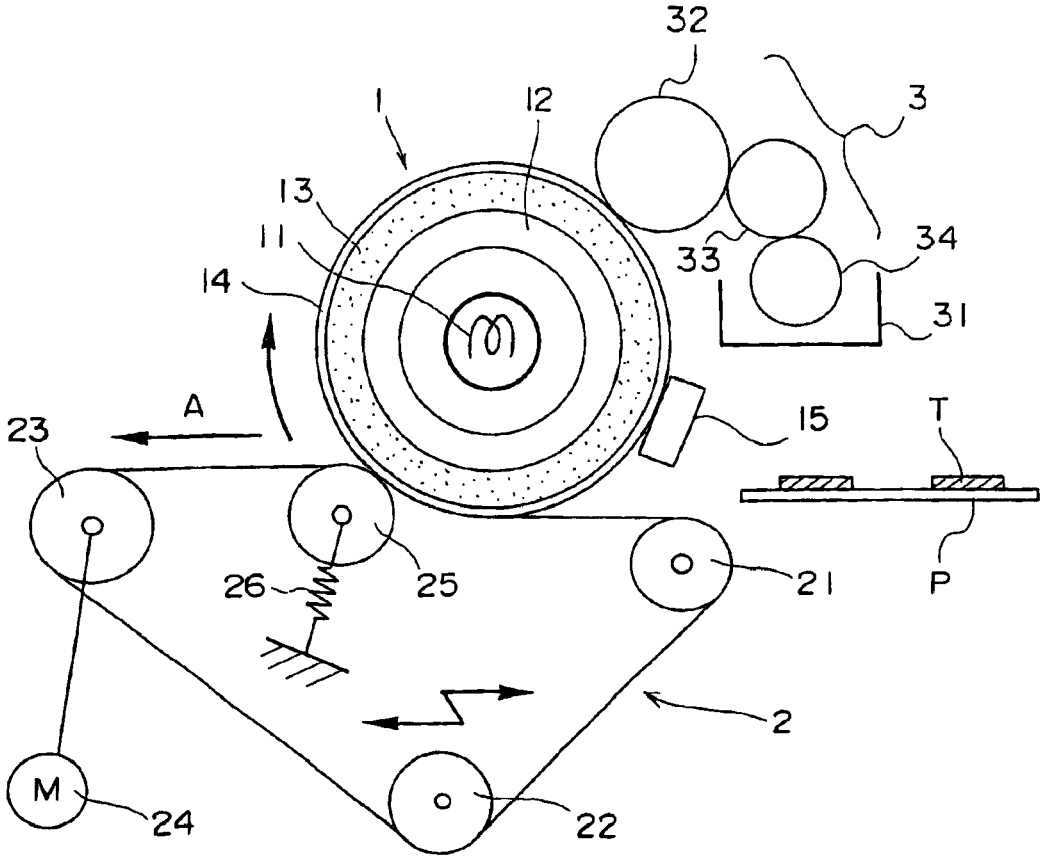
FIG. 2 is a schematic view showing one example of a fixing apparatus, which is applied to the image forming apparatus of the invention.

The aforementioned fixing step may be performed by using the fixing apparatus illustrated in FIG. 2. While referring to FIG. 2, the fixing apparatus used in the image forming method (image forming apparatus) of the invention will be explained. As show in FIG. 2, the fixing apparatus is provided with a heating fixing roll 1, a plurality of supporting rolls 21, 22, 23 and an endless belt (heat resistant belt) 2 tensed by these rolls. The fixing apparatus used in the invention may be provided with another endless belt so as to surround the heating fixing roll 1, and may be configured to form a nip between the fixing roll and the endless belt 2 via another such endless belt.

The heating fixing roll 1 is structured such that an undercoat layer (heat resistant elastomer layer) 13 composed of a heat resistant elastomer of 0.5 mm or larger, and a topcoat 14, cover successively on a hollow roll 12 made of a metal housing a halogen lamp 11, which acts as a heating source. The heating fixing roll 1 can be controlled at a predetermined temperature by monitoring the surface temperature with a temperature sensor 15. The thickness of the undercoat layer (heat resistant elastomer layer) 13 is preferably 0.5 mm or greater, and more preferably 1 mm or greater.

The endless belt 2 is wound around the heating fixing roll 1 at a predetermined angle so as to form a nip between the endless belt 2 and the heating fixing roll 1. This angle is usually in the range of 10 to 65°, more preferably in the range of 20 to 60°, and particularly preferable in the range of 30 to 50°.

The endless belt 2 is tensed by the rolls 21, 22 and 23, and since the supporting roll 23 is connected to a motor 24, the endless belt 2 can be rotatably driven. For this reason, the supporting roll 23 functions as a driving roll, and can rotate the endless belt 2 in an arrow A direction. Therefore, the heating fixing roll 1 in contact with the endless belt 2 follow-up rotates in an arrow A direction.

In addition, in the present fixing apparatus, a pressure roll 25 is further provided inside the endless belt 2 at an exit of a nip. The pressure roll 25 is contacted with the heating fixing roll 1 by pressure via the endless belt 2, by a connected compression coil spring 26. Hence, the pressure roll 25 can produce strain in the heat resistant elastomer layer of the heating fixing roll 1. Since the pressure roll 25 effectively provides strain to the heating fixing roll 1 at a low load, it is desirable that the roll 25 has a smaller diameter than that of the heating fixing roll 1, and that the surface thereof is hard.

When the pressure roll 25 and the heating fixing roll 1 are contacted under pressure under a load, the surface of the heating fixing roll 1 is elastically deformed at a nip region, and a strain is produced on the surface circumferentially. When the heating fixing roll 1 is rotated and a paper P is passed through a nip region in this state, the paper P is conveyed by a nip region with a strain.

Alternatively, the fixing apparatus may be provided with a mold releasing agent coating apparatus 3 effective in promoting release of a transfer receiving material. The mold releasing agent coating apparatus 3 is composed of a container 21 for a mold releasing agent, and three contacted rolls 32, 33, 34. The roll 32 which is one of them is disposed so as to contact with the heating fixing roll 1, and the roll 34 which is one of them is disposed so as to contact with a mold releasing agent accommodated in a container 31 for a mold releasing agent. The mold releasing agent is coated on a paper P via the heating fixing roll 1 from the mold releasing agent coating apparatus 3, and release of a paper P is performed smoothly.

When the mold releasing agent is coated on a paper P with the above-exemplified mold releasing agent coating apparatus 3, it is preferable that the mold releasing agent is coated on the heating fixing roll 1 so that an amount to be coated on a paper P becomes less than $2.0\times10^{-5}$g/cm$^2$.

When the coating amount exceeds the aforementioned upper limit, writing on a fixed image with a ballpoint pen and application of an adhesive tape may be adversely influenced, being not preferable. On the other hand, the coating amount is small, the function as a mold releasing agent cannot be sufficiently exerted, being not preferable.

It is preferable to use organosiloxane which is a silicone composition as a mold releasing agent, and an amino group-containing organosiloxane compound is more preferably used. In particular, by using an amino-modified silicone oil having a viscosity at 25° C. of 50 to 10,000 cs, more preferably 100 to 1,000 cs, the effect can be remarkably enhanced.

The endless belt 2 is tensed by at least three supporting rolls, one of these supporting rolls is a displacement roll, the other supporting rolls are a fixed roll, and the displacement roll may be constructed so that it can move so as to cross a position of a roll axis with roll axes of other fixed rolls. In this case, waving, creasing and damage of the endless belt 2 can be sufficiently suppressed.

Further, a central axis of the displacement roll may be constructed so as to displace along an elliptic locus, foci of which are central axes of two fixed rolls which are positioned on an upstream side and a downstream side nearest the displacement roll, relative to a rotation direction of the endless belt 2. In this case, a stress of the endless belt 2 is smallest and waving, creasing and damage of the endless belt 2 can be more sufficiently suppressed.

The heating fixing roll 1 may be constructed so as to form a nip with the endless belt 2 which is tensed between two fixed rolls. In this case, equal developability is obtained at a smaller load than that of a roll nip format, being suitable for high speed fixation.

On an upstream side of the pressure roll of a nip region formed by the heating fixing roll 1 and the endless belt 2, there may be further provided an elastomer roll contacting with the heating fixing roll 1 by pressure via the endless belt 2 from the inside of the endless belt 2. Whereby, the image alignment preventing function, the self stripping property, the fixability and the like are improved.

A fixing process with the thus constructed fixing apparatus is completed by transferring a paper (transfer receiving material) P having an unfixed toner image T to the endless belt 2, further, advancing P to a nip formed by the heating fixing roll 1 controlled at a predetermined temperature, and a pressure roll 25 via the endless belt 2, heating and contacting the P by pressure, and fixing a toner image T on a paper P.

(Toner Cartridge)

Then, the toner cartridge of the invention will be explained. The toner cartridge of the invention is a toner cartridge which is detachably mounted on an image forming apparatus and accommodates at least a toner to be supplied to developing means provided in the image forming apparatus, characterized in that the toner is the aforementioned toner of the invention.

Therefore, in an image forming apparatus having the essential feature by which a toner cartridge can be detached, since image formation can be performed using the toner of the invention excellent in the peelability at fixation and the shape controllability at toner preparation by utilizing a toner cartridge accommodating the toner of the invention, upon fixation, the peelability from a member contacting with a toner image is excellent, and occurrence of problems such as toner flight at development, the image quality reduction of the resulting image after fixation and the like can be prevented.

In the case where the image forming apparatus shown in FIG. 1 is an image forming apparatus having the essential feature by which a toner cartridge can be detached, for example, developing devices 104*a*, 104*b*, 104*c*, 104*d* are connected to toner cartridges (not shown) corresponding to respective developing devices (colors) with a toner supplying tube (not shown).

In this case, upon image formation, since toners are supplied to a developing device 104*a* through a toner supplying tube from toner cartridges corresponding to various developing devices (black), an image can be formed using the toner of the invention over a long period of time. In addition, when a toner accommodated in a toner cartridge is decreased, this toner cartridge can be exchanged.

EXAMPLES

The present invention will be explained in detail by way of the following Examples, however, the present invention is not limited thereto.

The toners used in these Examples can be obtained by the following methods.

In an emulsion aggregation and coalescent method, the following resin particles, magnetic metal particle dispersion (or colorant particle dispersion) and mold releasing agent particle dispersion are respectively prepared. At this time, a predetermined amount of a part of an inorganic metal salt polymer may be added in advance to the magnetic metal particle dispersion or the inorganic particle dispersion, and these are stirred to aggregate the material.

Then, while mixing and stirring the mixture present at a predetermined amount, a polymer of an inorganic metal salt is added for ionic neutralization, to form an aggregate for each of the the particles as described above. Before reaching the desired toner particle diameter, resin particles are further added to obtain the toner particle diameter. After the pH in the system is adjusted from weak acidic to a neutral range with an inorganic hydroxide, the material is heated to the temperature greater than or equal to the glass transition temperature of the resin particles in order to fuse and coalesce the material. After completion of the reaction, the desired toner is obtained via sufficient washing, solid-liquid separation and drying steps.

In addition, in a solubility emulsion aggregating coalescent method after pre-polymerization of a polymerizable monomer, this is emulsified with a mechanical shearing force in the presence of a surfactant and then thermally polymerized in the presence of a water-soluble polymerization initiator to obtain emulsified resin particles. Thereafter, by using this and performing the same procedures as those for the aggregating coalescent method, a toner is obtained.

Furthermore, in a suspension polymerization method, a monomer, a wax and magnetic metal particles are heated and mixed, and subjected to dispersion treatment by applying shear with a media-type dispersing machine. This is added to a pure water dispersion containing an adjusted inorganic dispersing agent, and an oily polymerization initiator dissolved in a polymerizable monomer is added, granulated with a homogenizer, and heated to obtain a polymer. Then the desired toner is obtained via washing, solid-liquid separation and drying.

In addition, in a solubility suspension method, a polymerizable monomer is pre-polymerized, and a wax and magnetic metal particles are dissolved in an organic solvent. This mixture is added to the aqueous system in which an inorganic dispersing agent is present, and suspended to a toner particle diameter by applying a mechanical shear with a homogenizer or the like. After cooling, solid-liquid separation and desolvation under reduced atmosphere afford the desired toner.

The methods for preparing each material, and a process for preparing the toner particles will be exemplified.

| (Preparation of resin particle dispersion 1) | |
|---|---|
| Styrene (manufactured by Wako Pure Chemical Industries, Ltd.) | 325 parts by mass |
| n-Butyl acrylate (manufactured by Wako Pure Chemical Industries, Ltd.) | 75 parts by mass |
| β-Carboxyethyl acrylate (manufactured by Rhodia Nicca, Ltd.) | 9 parts by mass |
| 1,10-Decanediol diacrylate (manufactured by Shin-Nakamura Chemical Co., Ltd.) | 1.5 parts by mass |
| Dodecanethiol (manufactured by Wako Pure Chemical Industries, Ltd.) | 2.7 parts by mass |

The above components were mixed and dissolved, and dispersed and emulsified in a solution in which 4 g of an anionic surfactant Dowfax (manufactured by The Dow Chemical Company) was dissolved in 550 g of ion-exchanged water and, while slowly stirring and mixing for 10 minutes, 50 g of ion-exchanged water in which 6 g of ammonium persulfate was dissolved, was placed therein.

Then, after nitrogen substitution in the system was sufficiently performed, the system was heated to 70° C. with an oil bath while stirring a flask, and emulsion polymerization was continued for 5 hours. In this manner, an anionic resin particle dispersion having a central diameter of 195 nm, an amount of solid matters of 42%, a glass transition point of 51.5° C. and Mw of 30000 was obtained.

In addition, the acid value of these resin particles (binder resin) obtained with KOH was 4.5 meq/mg-KOH.

| (Preparation of resin particle dispersion 2) | |
|---|---|
| Styrene (manufactured by Wako Pure Chemical Industries, Ltd.) | 275 parts by mass |
| n-Butyl acrylate (manufactured by Wako Pure Chemical Industries, Ltd.) | 75 parts by mass |
| β-Carboxyethyl acrylate (manufactured by Rhodia Nicca, Ltd.) | 9 parts by mass |
| 1,10-Decanediol diacrylate (manufactured by Shin-Nakamura Chemical Co., Ltd.) | 1.5 parts by mass |
| Dodecanethiol (manufactured by Wako Pure Chemical Industries, Ltd.) | 2.7 parts by mass |

The above components were charged into a 1 L flask, and were warmed to 65° C. while stirring. To this were added 50 parts by mass of styrene and 4.5 parts by mass of azobisvaleronitrile, and the materials were reacted for 8 hours in a nitrogen atmosphere to obtain a pre-polymerized solution of Mw of 29000.

This was added to a solution heated to 65° C. in which 20 parts by mass of Neogen was dissolved in 2 L of pure water, and then dispersed and emulsified for 5 minutes with a homogenizer (TK homomixer). Then, 4.2 parts by mass of ammonium peroxide were added to react for 6 hours, in order to obtain an emulsion polymerized resin particle dispersion. The central particle diameter was 220 nm.

In addition, the acid value of this resin particle (binder resin) obtained with KOH was 5.5 meq/mg-KOH.

(Preparation of Resin Particle Dispersion 3)

A resin particle dispersion having Mw of 15000 and a central particle diameter of 211 nm was obtained in the same manner as that for preparation of resin particle 2, except that the amount of azobisvaleronitrile added was 11 parts by mass, and the amount of ammonium peroxide was 6.3 parts by mass.The acid value of these resin particles (binder resin) obtained with KOH was 6.5 meq/mg-KOH.

(Preparation of Resin Particle Dispersion 4)

Preparation of Crystalline Resin 124 parts by mass of ethylene glycol, 22.2 parts by mass of sodium dimethyl 5-sulfoisophthalate, 213 parts by mass of dimethyl sebacate and 0.3 parts by mass of dibutyltin oxide as a catalyst were placed into a heat-dried three-neck flask. The air in the container was converted into an inert atmosphere with nitrogen gas by decompression, and the mixture was stirred at 180° C. for 5 hours by mechanical stirring. Thereafter, the temperature was gradually raised to 220° C. under reduced pressure, the material was stirred for 2 hours, and the reaction was stopped, whereby, 220 parts by mass of a crystalline polyester resin were synthesized.

The molecular weight (in terms of polystyrene) was measured by gel permeation chromatography (GPC), and it was found that a weight average molecular weight (Mw) of the resulting crystalline polyester resin (1) was 9700, and a number average molecular weight (Mn) was 5400.

In addition, a melting point (Tm) of the crystalline polyester resin was measured according to the aforementioned measuring method using a DSC, and it was found that the resin had a clear peak and a temperature of a peak top of 69° C.

In addition, the ratio of a copolymer component (5-sulfoisophthalic acid component) and a sebacic acid component was measured and calculated from the NMR spectrum of the resin, and was found to be 7.5:92.5.

Preparation of Resin Particle Dispersion 4

150 parts of a crystalline polyester resin were placed in 850 parts of distilled water, 10 parts of sodium dodecylbenzenesulfonate were added as a surfactant, and the materials were mixed and stirred with a homogenizer (manufactured by IKA Japan K.K.: ULTRA-TURRAX) while heating to 85° C., to obtain a resin particle dispersion.

The acid of thiese resin particles (binder resin) obtained with KOH was 0 meq/mg-KOH.

(Preparation of Resin Particle Dispersion 5)

Preparation of Non-Crystalline Polyester Resin 35 molar parts of polyoxyethylene (2,0)-2,2-bis(4-hydroxyphenyl)propane, 65 molar parts of polyoxypropylene (2,2)-2,2-bis(4-hydroxyphenyl)propane, 80 molar parts of terephthalic acid, 10 molar parts of n-dodecenylsuccinic acid, 10 molar parts of trimellitic acid, and 0.05 molar parts relative to these acid components (telephthalic acid, n-dodecenylsuccinic acid, trimellitic acid) of dibutyltin oxide were placed in a heat-dried two-neck flask. A nitrogen gas was introduced into the container to retain the inert atmosphere, the temperature was raised, a copolycondencing reaction was performed at 150 to 230° C. for about 12 hours and, thereafter, the pressure was gradually reduced at 210 to 250° C. to synthesize a non-crystalline polyester resin (1).

The molecular weight (in terms of polystyrene) was measured by gel permeation chromatography and, as a result, the weight average molecular weight (Mw) of the non-crystalline polyester resin was 15400, and the number average molecular weight (Mn) was 6800.

In addition, the DSC spectrum of the non-crystalline polyester resin was measured using a DSC as in the aforementioned measurement of the melting point, and a clear peak was not exhibited, and a step-wise change in the endothermic amount was observed. The glass transition point which is the middle point in the step-wise change in an endothermic amount was 65° C.

Preparation of Resin Particle Dispersion 5

150 parts of a non-crystalline polyester resin were placed into 850 parts of distilled water, 20 parts of sodium dodecylbenzenesulfonate as a surfactant were added, and the materials were mixed and stirred with a homogenizer (manufactured by IKA Japan K.K.: ULTRA-TURRAX) while heating to 99° C., to obtain a resin particle dispersion.

In addition, the acid value of this resin particle (binder resin) obtained with KOH was 7 meq/mg-KOH.

| (Preparation of colorant dispersion 1) | |
|---|---|
| Carbon black (R330 manufactured by Cabot Corporation) | 45 parts by mass |
| Ionic surfactant Neogen SC (manufactured by Dai-ichi Kogyo Seiyaku Co., Ltd.) | 5 parts by mass |
| Ion-exchanged water | 200 parts by mass |

The above components were mixed and dissolved, dispersed for 10 minutes with a homogenizer (ULTRA-TURRAX maufactured by IKA Japan K.K.) and then, ultrasound at 28 KHz was irradiated for 10 minutes using an ultrasound dispersing machine to obtain a colorant dispersion having a central particle diameter of 85 nm.

(Preparation of Magnetic Metal Particle Dispersion 1)

100 g of a ferrite particle MTS010 (manufactured by Toda Kogyo Corp.) having an average particle diameter of 90 nm was added to a solution in which 5 g of γ-aminopropyltriethoxysilane was dissolved in 100 g of pure water, and adhered to the surface of magnetic metal particles while mildly stirring for 30 minutes. Then, 5% by mass of Neogen SC (straight chain sodium alkylbenzenesulfonate, manufactured by Dai-ichi Kogyo Seiyaku Co., Ltd.) was placed therein, the mixture was warmed to 40° C., and stirred for 30 minutes to adhere the surfactant to the surface, in order to obtain a magnetic metal particle dispersion.

In addition, the solubility of the magnetic metal particles in a 1 mol/l aqueous $HNO_3$ solution at 50° C. was 480 mg/g·l. The acid value of the magnetic metal particles obtained with KOH was 4.5 meq/mg-KOH.

(Preparation of Magnetic Metal Particle Dispersion 2)

Preparation of this dispersion was the same as the procedure for preparation of the magnetic metal particle dispersion 1, except that the ferrite particles were changed to EPT305 (manufactured by Toda Kogyo Corp.) having an average particle diameter of 250 nm, surface treatment was performed with calcium carbonate, sodium dodecylbenzenesulfonate was changed to poly(sodium acrylate) and the addition amount was 12 parts by mass, whereby the dispersion was obtained.

In addition, the solubility of the magnetic metal particles in a 1 mol/l aqueous $HNO_3$ solution at 50° C. was 120 mg/g·l. The acid value of the magnetic metal particles obtained with KOH was 6.0 meq/mg-KOH.

(Preparation of Magnetic Metal Particle Dispersion 3)

The same procedure for preparation of the magnetic metal particle dispersion 1 was performed, except that the ferrite particles were changed to EPM 012s1 (manufactured by Toda Kogyo Corp.) having an average particle diameter of 120 nm, and surface treatment was performed with isopropyltitanium triisostearate, and the amount of sodium dodecylbenzenesulfonate added was changed to 8.4 parts by mass, whereby a dispersion was obtained.

In addition, the solubility of the magnetic metal particles in a 1 mol/l aqueous $HNO_3$ solution at 50° C. was 270 mg/g·l. The acid value of the magnetic metal particles obtained with KOH was 5.2 meq/mg-KOH.

(Preparation of Magnetic Metal Particle Dispersion 4)

The same procedure for preparing the magnetic metal particle dispersion 3 was used except that surface treatment was performed with sodium phosphate.

In addition, the solubility of the magnetic metal particles in a 1 mol/l aqueous $HNO_3$ solution at 50° C. was 370 mg/g·l. The acid value of the magnetic metal particles obtained with KOH was 2.7 meq/mg-KOH.

(Preparation of Magnetic Metal Particle Dispersion 5)

The same procedure for preparation of the magnetic metal particle dispersion 3 was performed except that the ferrite particles were changed to EPM012s1 (manufactured by Toda Kogyo Corp.) having an average particle diameter of 120 nm, and the dispersion was obtained.

In addition, the solubility of the magnetic metal particles in a 1 mol/l aqueous $HNO_3$ solution at 50° C. was 270 mg/g·l. The acid value of the magnetic metal particles obtained with KOH was 5.1 meq/mg-KOH.

(Preparation of Magnetic Metal Particle Dispersion 6)

The same procedure as that for preparation of the magnetic metal particle dispersion 3 was performed except that the ferrite particles were changed to EPM0045F (manufactured by Toda Kogyo Corp.) having an average particle diameter of 50 nm, and surface treatment was not performed, and the dispersion was obtained.

In addition, the solubility of the magnetic metal particles in a 1 mol/l aqueous $HNO_3$ solution at 50° C. was 940 mg/g·l. The acid value of the magnetic metal particles obtained with KOH was 0.4 meq/mg-KOH.

(Preparation of Magnetic Metal Particle Dispersion 7)

The same procedure as that for preparation of the magnetic metal particle dispersion 3 was performed except that the ferrite particles were changed to MTH009F having an average particle diameter of 300 nm, and surface treatment was not performed, and a dispersion was obtained.

In addition, the solubility of the magnetic metal particles in a 1 mol/l aqueous $HNO_3$ solution at 50° C. was 540 mg/g·l. The acid value of the magnetic metal particles obtained with KOH was 0.2 meq/mg-KOH.

(Preparation of mold releasing agent dispersion 1)

| | |
|---|---|
| Polyethylene Wax PW500 (mp: 85° C., viscosity: 5.2 mPa · s (180° C.), manufactured by Toyo-Petrolite) | 45 parts by mass |
| Cationic surfactant Neogen RK (manufactured by Dai-ichi Kogyo Seiyaku Co., Ltd.) | 5 parts by mass |
| Ion-exchanged water | 200 parts by mass |

The above components were heated to 95° C., dispersed sufficiently with ULTRA-TURRAX T50 manufactured by IKA Japan K.K., and dispersion-treated with a pressure discharge-type Gorin homogenizer to obtain a mold releasing agent dispersion having a central diameter of 200 nm and an amount of solid matters of 25%.

(Preparation of Mold Releasing Agent Dispersion 2)

The same procedure as that for preparation of the mold releasing agent dispersion 1 was performed except that Paraffin Wax HNP09 (mp: 78° C., viscosity: 2.5 mPa·s (180° C.), manufactured by Nippon Seiro Co., Ltd.) was used in place of Polyethylene Wax PW500, and the mold releasing agent dispersion having a central particle diameter of 192 nm and an amount of solid matters of 25% was obtained.

(Preparation of Mold Releasing Agent Dispersion 3)

The same procedure as that for preparation of the mold releasing agent dispersion 1 was performed except that Paraffin Wax (FT100, mp: 96° C., viscosity: 2.5 mPa·s (180° C.), manufactured by Shell Chemicals Japan Ltd.) was used in place of Polyethylene Wax PW500, and a mold releasing agent dispersion having a central particle diameter of 198 nm and the amount of solid matters obtained was 25%.

(Preparation of Mold Releasing Agent Dispersion 4)

The same procedure as that for preparation of the mold releasing agent dispersion 1 was performed except that Paraffin Wax #140 (mp: 61° C., viscosity: 1 mPa·s (180° C.), manufactured by Nippon Seiro Co., Ltd.) was used in place of Polyethylene Wax PW500, and a mold releasing agent dispersion having a central particle diameter of 199 nm and an amount of solid matters of 25% was obtained.

(Preparation of Mold Releasing Agent Dispersion 5)

The same procedure as that for preparation of the mold releasing agent dispersion 1 except that Polypropylene Wax (Ceridust 6071, mp: 131° C., viscosity: 140 mPa·s (180° C.), manufactured by Clariant (Japan) K.K.) was used in place of Polyethylene Wax PW500, and a mold releasing agent dispersion having a central particle diameter of 199 nm and an amount of solid matters of 25% was obtained.

(Preparation of Mold Releasing Agent Dispersion 6)

The same procedure as that for preparation of the mold releasing agent dispersion 1 was performed except that Polypropylene Wax (H12054 P41 mp: 90° C., viscosity: 40 mPa·s (180° C.), manufactured by Clariant (Japan) K.K.) was used in place of Polyethylene Wax PW500, and a mold releasing agent dispersion having a central particle diameter of 201 nm, and the amount of solid matters of 25% was obtained.

(Preparation of toner 1)

| | |
|---|---|
| Resin particle dispersion 2 | 80 parts by mass |
| Magnetic metal particle dispersion 1 | 12.5 parts by mass |
| Mold releasing agent dispersion 1 | 20 parts by mass |
| Poly (aluminium chloride) | 0.41 parts by mass |

The above components were sufficiently mixed and dispersed with ULTRA-TURRAX T50 in a round-type stainless flask.

Next, to this was added 0.36 parts by mass of poly (aluminium chloride), and the dispersing procedure with ULTRA-TURRAX was continued. The flask was heated to 47° C. with a heating oil bath while stirring. After being retained at 47° C. for 60 minutes, 31 g of the resin dispersion was mildly added thereto.

Thereafter, the pH in the system was adjusted to 5.4 with a 0.5 mol/L aqueous sodium hydroxide solution, the stainless flask was sealed and heated to 96° C. while stirring was continued using magnetic force sealing, and retained for 5 hours.

After completion of the reaction, the material was cooled, filtered, and sufficiently washed with ion-exchanged water, and solid-liquid separation was performed by Nutsche suction filtration. This was further redispersed in 3 L of ion-exchanged water at 40° C., and stirred and washed at 300 rpm for 15 minutes.

This was further repeated five times and, when the pH of the filtrate became 6.99, the electrical conductivity became 9.4 μs/cm, and the surface tension became 71.1 Nm, solid-liquid separation was performed by Nutsche suction filtration using a No. 5 A filter. Next, vacuum drying was continued for 12 hours.

The particle diameter at this time was measured with a Coulter Counter, and it was found that the volume average diameter D50 was 5.4 μm, and the volume average particle size distribution index GSDv was 1.20. In addition, it was observed that a shape coefficient SF1 of a particle obtained by shape observation with Luzex microscope was 128.9, being potato-like.

And, to 100 parts by mass of the resulting particle was added 0.5 parts by mass of hydrophobic silica (TS720: manufactured by Cabot Corporation), and the materials were blended with a sample mill to obtain a toner.

A storage modulus $G'_1$ at 180° C. and a frequency of 6.28 rad/s obtained from measurement of the dynamic viscoelasticity of this toner was $7.6\times10^4$ Pa, a ratio relative to a storage modulus $G'_2$ at a frequency of 64.8 rad/s was 1.8. In addition, a storage modulus at 120° C. and a frequency of 1 rad/s obtained from measurement of the dynamic viscoelasticity of this toner was $5.9\times10^4$ Pa. In addition, a melt viscosity of this toner at 120° C. was $7.4\times10^4$ Pa·s. An endothermic maximum obtained by differential thermo analysis of this toner was 85° C.

(Preparation of Toner 2)

The same procedure as that for preparation of an aggregated toner 2 was performed except that 100 parts by mass of a magnetic metal particle dispersion 2 was used, and 20 parts by mass of a mold releasing agent dispersion 2 was used, a volume average diameter D50 was 5.5 μm, and a volume average particle size distribution index GSDv was 1.25. In addition, a shape coefficient SF1 of a particle obtained by shape observation with Luzex microscope was 132.9, and a potato-like shape was observed.

A storage modulus $G'_1$ of this toner at 180° C. and a frequency of 6.28 rad/s obtained from measurement of a dynamic viscoelasticity was $9.8\times10^4$ Pa, and a ratio relative to a storage modulus $G'_2$ at a frequency of 64.8 rad/s was 1.1. In addition, a storage modulus of this toner at 120° C. and a frequency of 1 rad/s obtained from measurement of a dynamic viscoelasticity was $9.7\times10^4$ Pa. In addition, a melt viscosity of this toner at 120° C. was $9.6\times10^4$ Pa·s. An endothermic maximum of this toner obtained by differential thermo analysis was 75° C.

(Preparation of Toner 3)

The same procedure as that for preparation of an aggregated toner 1 was performed except that 50 parts by mass of a magnetic metal particle dispersion 3 was used, 60 parts by mass of a mold releasing agent dispersion 3 was used, and 20 parts by mass of carbon black for preparation of a colorant dispersion 1 was added, a volume average diameter D50 was 5.8 μm, and a volume average particle size distribution index GSDv was 1.24. In addition, a shape coefficient SF1 of a particle obtained by shape observation with Luzex microscope was 135.2, and a potato-like shape was observed.

A storage modulus $G'_1$ of this toner at 180° C. and a frequency of 6.28 rad/s obtained from measurement of a dynamic viscoelasticity was $9.47\times10^3$ Pa, and a ratio relative to a storage modulus $G'_2$ at a frequency of 64.8 rad/s was 1.7. In addition, a storage modulus of this toner at 120° C. and a frequency of 1 rad/s obtained from measurement of a dynamic viscoelasticity was $7.3\times10^3$ Pa. In addition, a melt viscosity of this toner at 120° C. was $2.9\times10^4$ Pa·s. An endothermic maximum of this toner obtained by differential thermo analysis was 96° C.

(Preparation of Toner 4)

The same procedure as that for preparation of an aggregated toner 1 was performed except that 80 parts by mass of a magnetic metal particle dispersion 4 was used, and 60 parts by mass of a mold releasing agent dispersion 2 was used, a volume average diameter D50 was 5.7 μm, and a volume average particle size distribution index GSDV was 1.22. In addition, a shape coefficient SF1 of a particle obtained by shape observation with Luzex microscope was 130.8, and a potato-like shape was observed.

A storage modulus $G'_1$ of this toner at 180° C. and a frequency of 6.28 rad/s obtained from measurement of a dynamic viscoelasticity was $9.4\times10^3$ Pa, and a ratio relative to a storage modulus $G'_2$ at a frequency of 64.8 rad/s was 2.0. In addition, a storage modulus of this toner at 120° C. and a frequency of 1 rad/s obtained from measurement of a dynamic viscoelasticity was $8.1\times10^4$ Pa. In addition, a melt viscosity of this toner at 120° C. was $7.0\times10^4$ Pa·s. An endothermic maximum of this toner obtained by differential thermo analysis was 75° C.

(Preparation of Toner 5)

The same procedure as that for preparation of an aggregated toner 1 was performed except that 80 parts by mass of a magnetic metal particle dispersion 5 was used, and 60 parts by mass of a mold releasing agent dispersion 2 was used, a volume average diameter D50 was 5.6 μm, and a volume average particle size distribution index GSDv was 1.21. In addition, a shape coefficient SF1 of a particle obtained by shape observation with Luzex microscope was 130.2, and a potato-like shape was observed.

A storage modulus $G'_1$ of this toner at 180° C. and a frequency of 6.28 rad/s obtained from measurement of a dynamic viscoelasticity was $8.4\times10^3$ Pa, and a ratio relative to a storage modulus $G'_2$ at a frequency of 64.8 rad/s was 1.7. In addition, a storage modulus of this toner at 120° C. and a frequency of 1 rad/s obtained from measurement of a dynamic viscoelasticity was $6.3\times10^4$ Pa. In addition, a melt viscosity of this toner at 120° C. was $6.5\times10^4$ Pa·s. An endothermic maximum of this toner obtained by differential thermo analysis was 96° C.

(Preparation of Toner 6)

75 parts by mass of styrene (manufacture by Wako Pure Chemical Industries, Ltd.) was added to Polyethylene Wax PW500 pre-heated to 60° C., and warmed and dissolved for 10 minutes. Then, to this was added 400 parts by mass of magnetic metal particles obtained by solid-liquid separation of a magnetic metal particle dispersion 1 with a No 5A filter, and the materials were dispersed at 60° C. for 2 hours with a media-type dispersing machine (Cobol Mill: Shinko Pantec Co., Ltd.) under the condition of a volume ratio of the dispersion and media of 1:2 using zirconium media of 2 mm ϕ. After completion of dispersion, discharge and cooling afforded a magnetic metal particle dispersion Wax.

Then, this was added to a mixture of 200 parts by mass of styrene (manufactured by Wako Pure Chemical Industries, Ltd.), 75 parts by mass of n-butyl acrylate (manufactured by Wako Pure Chemical Industries, Ltd.), 9 parts by mass of β-carboxyethyl acrylate (manufactured by Rhodea Nicca, Ltd.), 1.5 parts by mass of 1,10-decanediol diacrylate (manufactured by Shin-Nakamura Chemical Co., Ltd.) and 2.7 parts by mass of dodecanethiol (manufactured by Wako Pure Chemical Industries, Ltd.), the mixture was stirred at 60° C. for 15 minutes, and 24.5 parts by mass of azobisisobutylnitrile (manufactured by Wako Pure Chemical Industries, Ltd.) was added to 50 parts by mass of styrene, followed by vigorous stirring for 1 minute.

Then, 35 g of calcium phosphate (manufactured by Wako Pure Chemical Industries, Ltd.) was added to 2000 parts by mass of Pure Water in a 3 L flask, dispersed at 58° C. for 15 minutes with a homogenizer (Talax: manufactured by IKA Japan K.K.), and a total amount was granulated for 5 minutes. Thereafter, while performing nitrogen substitution rapidly, the reaction system was maintained at 75° C., and reacted for 8 hours to obtain a suspension particle having a particle diameter of 6.1 pm.

Thereafter, after cooled to a normal temperature, 30 mL of 1N HCl was added to dissolve and remove calcium phosphate, and solid-liquid separation was performed with a No 5A filter. Then, rinse with pure water was repeated until the filtrate exhibited neutral. After solid-liquid separation, drying afforded a suspension polymerized toner. A volume average diameter D50 of this toner was 6.5 μm, and a volume average particle size distribution index GSDv was 1.26. In addition, a shape coefficient SF1 of a particle obtained by shape observation with Luzex microscope was 117.3, and a spherical shape was observed.

A storage modulus $G'_1$ of this toner at 180° C. and a frequency of 6.28 rad/s obtained from measurement of a dynamic viscoelasticity was $8.1\times10^4$ Pa, and a ratio relative to a storage modulus $G'_2$ at a frequency of 64.8 rad/s was 1.7. In addition, a storage modulus of this toner at 120° C. and a frequency of 1 rad/s obtained from measurement of a dynamic viscoelasticity was $6.0\times10^4$ Pa. In addition, a melt viscosity of this toner at 120° C. was $6.6\times10^4$ Pa·s. An endothermic maximum of this toner obtained by differential thermo analysis was 91° C.

(Preparation of Toner 7)

The same procedure as that for preparation of a toner 1 was performed except that 80 parts by mass of a magnetic metal particle dispersion 5 was used, 60 parts by mass of a mold releasing agent dispersion 2 was used, and 40 parts by mass of a resin particle dispersion 2 was used, a volume average diameter D50 was 5.9 μm, and a volume average particle size distribution index GSDv was 1.22. In addition, a shape coefficient SF1 of a particle obtained from shape observation with Luzex microscope was 130.6, and a potato-like shape was observed.

A storage modulus $G'_1$ of this toner at 180° C. and a frequency of 6.28 rad/s obtained from measurement of a dynamic viscoelasticity was $4.9\times10^4$ Pa, and a ratio relative to a storage modulus $G'_2$ at a frequency of 64.8 rad/s was 2.1. In addition, a storage modulus of this toner at 120° C. and a frequency of 1 rad/s obtained from measurement of a dynamic viscoelasticity was $5.4\times10^4$ Pa. In addition, a melt viscosity of this toner at 120° C. was $5.3\times10^4$ Pa·s. An endothermic maximum of this toner obtained by differential thermo analysis was 78° C.

(Preparation of Toner 8)

The same manner as that for preparation of a toner 5 was performed except that a resin particle dispersion 3 was used instead of a resin particle dispersion 1, a volume average diameter D50 was 6.1 μm, and a volume average particle size distribution index GSDv was 1.27. In addition, a shape coefficient SF1 of a particle obtained from shape observation with Luzex microscope was 125.7, and a potato-like shape was observed.

A storage modulus $G'_1$ of this toner at 180° C. and a frequency of 6.28 rad/s obtained from measurement of a dynamic viscoelasticity was $2.54\times10^3$ Pa, and a ratio relative to a storage modulus $G'_2$ at a frequency of 64.8 rad/s was 2.4. In addition, a storage modulus of this toner at 120° C. and a frequency of 1 rad/s obtained from measurement of a dynamic viscoelasticity was $2.9\times10^4$ Pa. In addition, a melt viscosity of this toner at 120° C. was $9.6\times10^3$ Pa·s. An endothermic maximum of this toner obtained by differential thermo analysis was 96° C.

(Preparation of Toner 9)

The same procedure as that for preparation of a toner 1 was performed except that 5 parts by mass of a magnetic metal particle dispersion 6 was used, and 8 parts by mass of a mold releasing agent dispersion 4 was used, a volume average diameter D50 was 5.8 μm, and a volume average particle size distribution index GSDv was 1.22. In addition, a shape coefficient SF1 of a particle obtained from shape observation with a Luzex microscope was 131.2, and a potato-like shape was observed.

A storage modulus $G'_1$ of this toner at 180° C. and a frequency of 6.28 rad/s obtained from measurement of a dynamic viscoelasticity was $7.24\times10^2$ Pa, and a ratio relative to a storage modulus $G'_2$ at a frequency of 64.8 rad/s was 2.73. In addition, a storage modulus of this toner at 120° C. and a frequency of 1 rad/s obtained from measurement of a dynamic viscoelasticity was $7.24\times10^2$ Pa. In addition, a melt viscosity of this toner at 120° C. was $9.2\times10^2$ Pa·s. An endothermic maximum of this toner obtained by differential thermo analysis was 61° C.

(Preparation of Toner 10)

The same procedure as that for preparation of a toner 1 was performed except that 150 parts by mass of a magnetic metal particle dispersion 7 was used, and 160 parts by mass of a mold releasing agent dispersion 5 was used, a volume average diameter D50 was 6.1 μm, and a volume average particle size distribution index GSDv was 1.29. In addition, a shape coefficient SF1 of a particle obtained from shape observation with Luzex microscope was 134.5, and a potato-like shape was observed.

A storage modulus $G'_1$ of this toner at 180° C. and a frequency of 6.28 rad/s obtained from measurement of a dynamic viscoelasticity was $1.39\times10^6$ Pa, and a ratio relative to a storage modulus $G'_2$ at a frequency of 64.8 rad/s was 0.95. In addition, a storage modulus of this toner at 120° C. and a frequency of 1 rad/s obtained from measurement of a dynamic viscoelasticity was $1.6\times10^5$ Pa. In addition, a melt viscosity of this toner at 120° C. was $1.9\times10^5$ Pa·s. An endothermic maximum of this toner obtained by differential thermo analysis was 61° C.

(Preparation of Toner 11)

The same procedure as that for preparation of a toner 1 was performed except that 150 parts by mass of a magnetic metal particle dispersion 7 was used, and 8 parts by mass of a mold releasing agent dispersion 6 was used, a volume average diameter D50 was 6.1 μm, and a volume average particle size distribution index GSDV was 1.29. In addition, a shape coefficient SF1 of a particle obtained from shape observation with Luzex microscope was 133.5, and a potato-like shape was observed.

A storage modulus $G'_1$ of this toner at 180° C. and a frequency of 6.28 rad/s obtained from measurement of a dynamic viscoelasticity was $2.63\times10^5$ Pa, and a ratio relative to a storage modulus $G'_2$ at a frequency of 64.8 rad/s was 0.97. In addition, a storage modulus of this toner at 120° C. and a frequency of 1 rad/s obtained from measurement of a dynamic viscoelasticity was $2.33\times10^5$ Pa. In addition, a melt viscosity of this toner at 120° C. was $2.4\times10^5$ Pa·s. An endothermic maximum of this toner obtained by differential thermo analysis was 90° C.

(Preparation of Toner 12)

The same procedure as that for preparation of a toner 6 was performed except that 150 parts by mass of magnetic metal particles used in the magnetic metal particle dispersion 7 and 8 parts by mass of a mold releasing agent used in the mold releasing agent dispersion 5 were employed, a volume average particle diameter D50 was 6.2 μm, and a volume average particle size distribution index GSD v was 1.38. In addition, a shape coefficient SF1 of a particle obtained by shape observation with Luzex was 134, and a spherical shape was observed.

A storage modulus $G'_1$ of this toner at 180° C. and a frequency of 6.28 rad/s obtained from measurement of a dynamic viscoelasticity was $8.76\times10^5$ Pa, and a ratio relative to a storage modulus $G'_2$ at a frequency of 64.8 rad/s was 2.8. In addition, a storage modulus of this toner at 120° C. and a frequency of 1 rad/s obtained from measurement of a dynamic viscoelasticity was $6.3\times10^5$ Pa. In addition, a melt viscosity of this toner at 120° C. was $1.7\times10^6$ Pa·s. An endothermic maximum of this toner obtained by differential thermo analysis was 91° C.

(Preparation of Toner 13)

The same procedure as that for preparation of a toner 7 was performed except that 20 parts by mass of magnetic metal particles used in the magnetic metal particle dispersion 7 and 8 parts by mass of a mold releasing agent used in the mold releasing agent dispersion 5 were employed, a volume average particle diameter D50 was 6.34 μm, and a volume average particle size distribution index GSD v was 1.31. In addition, a shape coefficient SF1 of a particle obtained by shape observation with Luzex was 114.9, and a spherical shape was observed.

A storage modulus $G'_1$ of this toner at 180° C. and a frequency of 6.28 rad/s obtained from measurement of a dynamic viscoelasticity was $9.236\times10^5$ Pa, and a ratio relative to a storage modulus $G'_2$ at a frequency of 64.8 rad/s was 2.9. In addition, a storage modulus of this toner at 120°

C. and a frequency of 1 rad/s obtained from measurement of a dynamic viscoelasticity was $7.6\times10^2$ Pa. In addition, a melt viscosity of this toner at 120° C. was $1.1\times10^4$ Pa·s. An endothermic maximum of this toner obtained by differential thermo analysis was 131° C.

(Preparation of Toner 14)

The same procedure as that for preparation of a toner 8 was performed except that 150 parts by mass of magnetic metal particles obtained by surface-treating the magnetic metal particles used in the magnetic metal particle dispersion 1, and 8 parts by mass of a mold releasing agent used in the mold releasing agent dispersion 5 were used, a volume average diameter D50 was 6.22 μm, and a volume average particle size distribution index GSD v was 1.27. A shape coefficient SF1 of a particle obtained by shape observation with Luzex was 129.9, and a potato-like shape was observed.

A storage modulus $G'_1$ of this toner at 180° C. and a frequency of 6.28 rad/s obtained from measurement of a dynamic viscoelasticity was $9.9\times10^5$ Pa, and a ratio relative to a storage modulus $G'_2$ at a frequency of 64.8 rad/s was 2.7. In addition, a storage modulus of this toner at 120° C. and a frequency of 1 rad/s obtained from measurement of a dynamic viscoelasticity was $9.8\times10^6$ Pa. In addition, a melt viscosity of this toner at 120° C. was $9.2\times10^4$ Pa·s. An endothermic maximum of this toner obtained by differential thermo analysis was 131° C.

(Preparation of Toner 15)

The same procedure as that for preparation of a toner 1 was performed except that 10 parts by mass of magnetic metal particles obtained by surface-treating the magnetic metal particles used in the magnetic metal particle dispersion 1, and 80 parts by mass of a mold releasing agent used in the mold releasing agent dispersion 5 were used, a volume average diameter D50 was 6.22 μm, and a volume average particle size distribution index GSD v was 1.37. A shape coefficient SF1 of a particle obtained by shape observation with Luzex was 115.9, and a spherical shape was observed.

A storage modulus $G'_1$ of this toner at 180° C. and a frequency of 6.28 rad/s obtained from measurement of a dynamic viscoelasticity was $9.836\times10^5$ Pa, and a ratio relative to a storage modulus $G'_2$ at a frequency of 64.8 rad/s was 2.6. In addition, a storage modulus of this toner at 120° C. and a frequency of 1 rad/s obtained from measurement of a dynamic viscoelasticity was $1.3\times10^2$ Pa. In addition, a melt viscosity of this toner at 120° C. was $9.3\times10^2$ Pa·s. An endothermic maximum of this toner obtained by differential thermo analysis was 131° C.

(Preparation of toner A)

| | |
|---|---|
| Resin particle dispersion 4 | 600 parts by mass |
| Magnetic metal particle dispersion 1 | 100 parts by mass |
| Mold mold releasing agent dispersion 1 | 66 parts by mass |
| Poly(aluminium chloride) | 5 parts by mass |
| Ion-exchanged water | 100 parts by mass |

The above components were placed into a round-type stainless flask, adjusted to a pH of 3.0, dispersed using a homogenizer (manufactured by IKA Japan K.K.: ULTRA-TURRAXT50), and heated to 65° C. in a heating oil bath while stirring. After retained at 65° C. for 3 hours, observation with a light microscope was performed, and it was confirmed that an aggregated particle having an average particle diameter of about 5.0 μm was formed. Further, after heating and stirring were retained at 65° C. for 1 hour, observation with a light microscope was performed, and it was confirmed that an aggregated particle having an average particle diameter of 5.5 μm was formed.

A pH of this aggregated particle dispersion was 3.8. Then, an aqueous solution obtained by diluting sodium carbonate (manufactured by Wako Pure Chemical Industries, Ltd.) to 0.5% by mass was mildly added to adjust pH to 5.0. A temperature of this aggregated particle dispersion was risen to 80° C. while stirring was continued, and that temperature was retained for 30 minutes. Observation with a light microscope was performed, and a coalesced spherical particle was observed. Thereafter, a temperature was fallen to 30° C. at a rate of 10° C./min while adding ion-exchanged water, to solidify a particle.

Thereafter, the reaction product was filtered, sufficiently washed with ion-exchanged water, and dried using a vacuum dryer to obtain a coloring particle.

This coloring particle was measured using a Coulter Counter [TA-II] type (aperture diameter: 50 μm, manufactured by Coulter) and it was found that a volume average particle diameter was 5.5 μm, a number average particle diameter was 4.6 μm, and a volume average particle size distribution index GSDv was 1.25. In addition, a shape coefficient SF1 of a particle obtained by shape observation with Luzex microscope was 121, and a spherical shape was observed.

To the resulting coloring particles were added 0.8% by mass of silica particles (manufactured by Nippon Aerosil Co., Ltd., hydrophobic silica: RX50) having the hydrophobicizing-treated surface and an average primary particle diameter of 40 nm, and 1.0% by mass of metatitanic acid compound particles having an average primary particle diameter of 20 μm which was the reaction product obtained by treating 100 parts by mass of metatitanic acid with 40 parts by mass of isobutyltrimethoxysilane and 10 parts by mass of trifluoropropyltrimethoxysilane, and the materials were mixed with a Henshel mixer for 5 minutes. Thereafter, the mixture was classified with a 45 μm mesh sieve to prepare a toner.

A storage modulus $G'_1$ of this toner at 180° C. and a frequency of 6.28 rad/s obtained from measurement of a dynamic viscoelasticity was $9\times10^3$ Pa, and a ratio relative to a storage modulus $G'_2$ at a frequency of 64.8 rad/s was 1.8. In addition, a storage modulus of this toner at 120° C. and an angular frequency of 1 rad/s obtained from measurement of a dynamic viscoelasticity was 31100 Pa. In addition, a melt viscosity of this toner at 120° C. was 800 Pa·s. An endothermic maximum of this toner obtained by differential thermo analysis was 68° C.

Preparation of Toner B

The same procedure as that for preparation of a toner A was performed except that a resin particle dispersion 5 was used, a volume average diameter D50 was 5.6 μm and a volume average particle size distribution index GSDv was 1.30. In addition, a shape coefficient SF1 of a particle obtained by shape observation with Luzex microscope was 120, and a spherical shape was observed.

A storage modulus $G'_1$ of this toner at 180° C. and a frequency of 6.28 rad/s obtained from measurement of a dynamic viscoelasticity was $8\times10^3$ Pa, and a ratio relative to a storage modulus $G'_2$ at a frequency of 64.8 rad/s was 1.5. In addition, a storage modulus of this toner at 150° C. and an angular frequency of 6.28 rad/s obtained from measurement of a dynamic viscoelasticity was 31000 Pa. In addition, a melt viscosity of this toner at 120° C. was 300 Pa·s. An endothermic maximum of this toner obtained by differential thermo analysis was 67° C.

Preparation of Toner C

The same procedure as that for preparation of a toner A was performed except that 250 parts by mass of a magnetic metal particle dispersion 1, and 60 parts by mass of a mold releasing agent dispersion 1 were used, and 20 parts by mass of carbon black for the colorant dispersion (1) was added, a volume average diameter D50 was 5.8 μm and a volume average particle size distribution index GSDv was 1.28. In addition, a shape coefficient SF1 of a particle obtained by shape observation with Luzex microscope was 123, and a spherical shape was observed.

A storage modulus $G'_1$ of this toner at 180° C. and a frequency of 6.28 rad/s obtained from measurement of a dynamic viscoelasticity was 3000 Pa, and a ratio relative to a storage modulus $G'_2$ at a frequency of 64.8 rad/s was 2.5. In addition, a storage modulus of this toner at 120° C. and an angular frequency of 6.28 rad/s obtained from measurement of a dynamic viscoelasticity was 50,000 Pa. In addition, a melt viscosity of this toner at 120° C. was 3000 Pa·s. An endothermic maximum of this toner obtained by differential thermo analysis was 69° C.

Preparation of Toner D

The same procedure as that for preparation of a toner A was performed except that 250 parts by mass of a magnetic metal particle dispersion 2 and 60 parts by mass of a mold releasing agent dispersion 2 were used, a volume average diameter D50 was 5.7 μm and a volume average particle size distribution index GSDv was 1.26. In addition, a shape coefficient SF1 of a particle obtained by shape observation with Luzex microscope was 120, and a spherical shape was observed.

A storage modulus $G'_1$ of this toner at 180° C. and a frequency of 6.28 rad/s obtained from measurement of a dynamic viscoelasticity was 3500 Pa, and a ratio relative to a storage modulus $G'_2$ at a frequency of 64.8 rad/s was 2.9. In addition, a storage modulus of this toner at 120° C. and an angular frequency of 6.28 rad/s obtained from measurement of a dynamic viscoelasticity was 58700 Pa. In addition, a melt viscosity of this toner at 120° C. was 300 Pa·s. An endothermic maximum of this toner obtained by differential thermo analysis was 69° C.

Preparation of a Toner E

The same procedure as that for preparation of a toner A was performed except that 300 parts by mass of a magnetic metal particle dispersion 3 and 60 parts by mass of a mold releasing agent dispersion 3 were used, a volume average diameter D50 was 5.6 μm and a volume average particle size distribution index GSDv was 1.28. In addition, a shape coefficient SF1 of a particle obtained by shape observation with Luzex microscope was 120, and a spherical shape was observed.

A storage modulus $G'_1$ of this toner at 180° C. and a frequency of 6.28 rad/s obtained from measurement of a dynamic viscoelasticity was 2900 Pa, and a ratio relative to a storage modulus $G'_2$ at a frequency of 64.8 rad/s was 2.8. In addition, a storage modulus of this toner at 120° C. and an angular frequency of 6.28 rad/s obtained from measurement of a dynamic viscoelasticity was 65700 Pa. In addition, a melt viscosity of this toner at 120° C. was 3000 Pa·s. An endothermic maximum of this toner obtained by differential thermo analysis was 67° C.

Preparation of Toner F

The same procedure as that for preparation of a toner A was performed except that 250 parts by mass of a magnetic metal particle dispersion 4 and 60 parts by mass of a mold releasing agent dispersion 4 were used, a volume average diameter D50 was 5.6 μm and a volume average particle size distribution index GSDv was 1.28. In addition, a shape coefficient SF1 of a particle obtained by shape observation with Luzex microscope was 120, and a spherical shape was observed.

A storage modulus $G'_1$ of this toner at 180° C. and a frequency of 6.28 rad/s obtained from measurement of a dynamic viscoelasticity was 3800 Pa, and a ratio relative to a storage modulus $G'_2$ at a frequency of 64.8 rad/s was 2.0. In addition, a storage modulus of this toner at 120° C. and an angular frequency of 6.28 rad/s obtained from measurement of a dynamic viscoelasticity was 72600 Pa. In addition, a melt viscosity of this toner at 120° C. was 800 Pa·s. An endothermic maximum of this toner obtained by differential thermo analysis was 69° C.

(Preparation of Toner G)

The same procedure as that for preparation of a toner A was performed except that 300 parts by mass of a magnetic metal particle dispersion 6 and 60 parts by mass of a mold releasing agent dispersion 5 were used, a volume average diameter D50 was 5.6 μm and a volume average particle size distribution index GSDv was 1.28. In addition, a shape coefficient SF1 of a particle obtained by shape observation with Luzex microscope was 120, and a spherical shape was observed.

A storage modulus $G'_1$ of this toner at 180° C. and a frequency of 6.28 rad/s obtained from measurement of a dynamic viscoelasticity was 3400 Pa, and a ratio relative to a storage modulus $G'_2$ at a frequency of 64.8 rad/s was 1.9. In addition, a storage modulus of this toner at 120° C. and an angular frequency of 6.28 rad/s obtained from measurement of a dynamic viscoelasticity was 65000 Pa. In addition, a melt viscosity of this toner at 120° C. was 1000 Pa·s. An endothermic maximum of this toner obtained by differential thermo analysis was 69° C.

(Preparation of Toner H)

The same procedure as that for preparation of a toner A was performed except that 700 parts by mass of a magnetic metal particle dispersion 7 and 60 parts by mass of a mold releasing agent dispersion 6 were used, a volume average diameter D50 was 5.6 μm and a volume average particle size distribution index GSDv was 1.28. In addition, a shape coefficient SF1 of a particle obtained by shape observation with Luzex microscope was 120, and a spherical shape was observed.

A storage modulus $G'_1$ of this toner at 180° C. and a frequency of 6.28 rad/s obtained from measurement of a dynamic viscoelasticity was 3650 Pa, and a ratio relative to a storage modulus $G'_2$ at a frequency of 64.8 rad/s was 1.9. In addition, a storage modulus of this toner at 120° C. and an angular frequency of 6.28 rad/s obtained from measurement of a dynamic viscoelasticity was 45200 Pa. In addition, a melt viscosity of this toner at 120° C. was 800 Pa·s. An endothermic maximum of this toner obtained by differential thermo analysis was 69° C.

Example 1

An image was formed with a modified Laser Press 4161 machine (manufactured by Fuji Xerox Co., Ltd.) using a toner 1 by adjusting a toner carrying amount to 4.5 g/m$^2$, and was fixed at a Nip width of 6.5 mm and a fixing rate of 200 mm/sec using a high speed/low pressure/low power-type fixing device shown in FIG. 2. An image forming method was an image forming method comprising an electrifying step of electrifying the surface of an image supporting member, an electrostatic latent image forming step of forming an electrostatic latent image corresponding to image information on the surface of the electrified image supporting member, a developing step of developing the electrostatic latent image formed on the surface of the image supporting member with a developer containing at least a toner to obtain a toner image, and a fixing step of fixing the toner image onto the surface of a recording medium. In addition, a toner 1 was filled into a toner cartridge of Laser Press 4161 (manufactured by Fuji Xerox Co., Ltd.), copying was performed over a long term, and the better image was continuously obtained.

The resulting image was assessed, and it was confirmed that a degree of blackness of this image was better, toner flight and graphic fog were not observed, and the better electrifiability was exhibited.

In addition, it was confirmed that the peelability with a fixing device was better, and there was peeling without any resistance, and no offset occurred. In addition, the fixed image was bent into two parts, and extended again and, thereupon, image defect was not observed. Further, upon image formation, toner flight and graphic fog were not observed.

Example 2

An image was formed with a modified Laser Press 4161 machine (manufactured by Fuji Xerox Co., Ltd.) using a toner 2 by adjusting a toner carrying amount to 4.5 g/m$^2$, and was fixed at a Nip width of 6.5 mm and a fixing rate of 200 mm/sec using a high speed/low pressure/low power-type fixing device shown in FIG. 2.

The resulting image was assessed, it was confirmed that a degree of blackness of this image was better, and a precise image was obtained. Further, it was confirmed that toner flight and graphic fog were not observed, and the better electrifiability was exhibited.

In addition, it was confirmed that the peelability with a fixing device was better, and there was peeling without any resistance, and no offset occurred. In addition, the fixed image was bent into two parts, and extended again and, thereupon, image defect was not observed. Further, upon image formation, toner flight and graphic fog were not observed.

Example 3

An image was formed with a modified Laser Press 4161 machine (manufactured by Fuji Xerox Co., Ltd.) using a toner 3 by adjusting a toner carrying amount to 4.5 g/m$^2$, and was fixed at a Nip width of 6.5 mm and a fixing rate of 200 mm/sec using a high speed/low pressure/low power-type fixing device shown in FIG. 2.

The resulting image was assessed, it was confirmed that a degree of blackness of this image was better, and a precise image was obtained. In addition, it was confirmed that toner flight and graphic fog were not observed, and the better electrifiability was exhibited.

In addition, it was confirmed that the peelability with a fixing device was better, and there was peeling without any resistance, and no offset occurred. In addition, the fixed image was bent into two parts, and extended again and, thereupon, image defect was not observed. Further, upon image formation, toner flight and graphic fog were not observed.

Example 4

An image was formed with a modified Laser Press 4161 machine (manufactured by Fuji Xerox Co., Ltd.) using a toner 4 by adjusting a toner carrying amount to 4.5 g/m$^2$, and was fixed at a Nip width of 6.5 mm and a fixing rate of 200 mm/sec using a high speed/low pressure/low power-type fixing device shown in FIG. 2.

The resulting image was assessed, it was confirmed that a degree of blackness of this image was better, and a precise image was obtained. In addition, it was confirmed that toner flight and graphic fog were not observed, and the better electrifiability was exhibited.

In addition, it was confirmed that the peelability with a fixing device was better, and there was peeling without any resistance, and no offset occurred. In addition, the fixed image was bent into two parts, and extended again and, thereupon, image defect was not observed. Further, upon image formation, toner flight and graphic fog were not observed.

Example 5

An image was formed with a modified Laser Press 4161 machine (manufactured by Fuji Xerox Co., Ltd.) using a toner 5 by adjusting a toner carrying amount to 4.5 g/m$^2$, and was fixed at a Nip width of 6.5 mm and a fixing rate of 200 mm/sec using a high speed/low pressure/low power-type fixing device shown in FIG. 2.

The resulting image was assessed, it was confirmed that a degree of blackness of this image was better, and a precise image was obtained. In addition, it was confirmed that toner flight and graphic fog were not observed, and the better electrifiability was exhibited.

In addition, it was confirmed that the peelability with a fixing device was better, and there was peeling without any resistance, and no offset occurred. In addition, the fixed image was bent into two parts, and extended again and, thereupon, image defect was not observed. Further, upon image formation, toner flight and graphic fog were not observed.

Example 6

An image was formed with a modified Laser Press 4161 machine (manufactured by Fuji Xerox Co., Ltd.) using a toner 6 by adjusting a toner carrying amount to 4.5 g/m$^2$, and was fixed at a Nip width of 6.5 mm and a fixing rate of 200 mm/sec using a high speed/low pressure/low power-type fixing device shown in FIG. 2.

The resulting image was assessed, it was confirmed that a degree of blackness of this image was better, and a precise image was obtained. In addition, it was confirmed that toner flight and graphic fog were not observed, and the better electrifiability was exhibited.

In addition, it was confirmed that the peelability with a fixing device was better, and there was peeling without any resistance, and no offset occurred. In addition, the fixed image was bent into two parts, and extended again and, thereupon, image defect was not observed. Further, upon image formation, toner flight and graphic fog were not observed.

Example 7

An image was formed with a modified Laser Press 4161 machine (manufactured by Fuji Xerox Co., Ltd.) using a toner 7 by adjusting a toner carrying amount to 4.5 g/m$^2$, and was fixed at a Nip width of 6.5 mm and a fixing rate of 200 mm/sec using a high speed/low pressure/low power-type fixing device shown in FIG. 2.

The resulting image was assessed, it was confirmed that a degree of blackness of this image was better, and a precise image was obtained. In addition, it was confirmed that toner flight and graphic fog were not observed, and the better electrifiability was exhibited.

In addition, it was confirmed that the peelability with a fixing device was better, and there was peeling without any resistance, and no offset occurred. In addition, the fixed image was bent into two parts, and extended again and, thereupon, image defect was not observed.

Example 8

An image was formed with a modified Laser Press 4161 machine (manufactured by Fuji Xerox Co., Ltd.) using a toner 8 by adjusting a toner carrying amount to 4.5 g/m$^2$, and was fixed at a Nip width of 6.5 mm and a fixing rate of 200 mm/sec using a high speed/low pressure/low power-type fixing device shown in FIG. 2.

The resulting image was assessed, it was confirmed that a degree of blackness of this image was better, and a precise image was obtained. In addition, it was confirmed that toner flight and graphic fog were not observed, and the better electrifiability was exhibited.

In addition, it was confirmed that the peelability with a fixing device was better, and there was peeling without any resistance, and no offset occurred. In addition, the fixed image was bent into two parts, and extended again and, thereupon, image defect was not observed.

Comparative Example 1

An image was formed with a modified Laser Press 4161 machine (manufactured by Fuji Xerox Co., Ltd.) using a toner 9 by adjusting a toner carrying amount to 4.5 g/m$^2$, and was fixed at a Nip width of 6.5 mm and a fixing rate of 240 mm/sec using a high speed/low pressure/low power-type fixing device shown in FIG. 2.

The resulting image was assessed, and a degree of blackness of this image was insufficient. In addition, toner flight and graphic fog were not observed.

In addition, the peelability with a fixing device was poor, and the uneven glossiness occurred deriving from defective peeling of the fixed image. Further, offset occurred. However, the fixed image was bent into two parts, and extended again and, thereupon, image defect was not observed.

Comparative Example 2

An image was formed with a modified Laser Press 4161 machine (manufactured by Fuji Xerox Co., Ltd.) using a toner 10 by adjusting a toner carrying amount to 4.5 g/m$^2$, and was fixed at a Nip width of 6.5 mm and a fixing rate of 240 mm/sec using a high speed/low pressure/low power-type fixing device shown in FIG. 2.

The resulting image was assessed, and a degree of blackness of this image was sufficient, but a precise image was not observed. In addition, toner flight and graphic fog were observed, and it was confirmed that the sufficient electrifiability was not obtained.

In addition, the peelability with a fixing device was sufficient, but offset which is Wax-derived defect occurred. However, the fixed image was bent into two parts, and extended again and, thereupon, image defect was observed.

Comparative Example 3

An image was formed with a modified Laser Press 4161 machine (manufactured by Fuji Xerox Co., Ltd.) using a toner 11 by adjusting a toner carrying amount to 4.5 g/m$^2$, and was fixed at a Nip width of 6.5 mm and a fixing rate of 240 mm/sec using a high speed/low pressure/low power-type fixing device shown in FIG. 2.

The resulting image was assessed, and a degree of blackness of this image was sufficient, but a precise image was not observed. In addition, toner flight and graphic fog were observed, and it was confirmed that the sufficient electrifiability was not obtained.

In addition, the peelability with a fixing device was poor, and the uneven glossiness occurred deriving from peeling defect of the fixed image. Further, offset occurred. In addition, the fixed image was bent into two parts, and extended again and, thereupon, image defect was observed.

Comparative Example 4

An image was formed with a modified Laser Press 4161 machine (manufactured by Fuji Xerox Co., Ltd.) using a toner 12 by adjusting a toner carrying amount to 4.5 g/M$^2$, and was fixed at a Nip width of 6.5 mm and a fixing rate of 240 mm/sec using a high speed/low pressure/low power-type fixing device shown in FIG. 2.

The resulting image was assessed, and a degree of blackness of this image was insufficient, and a precise image was not observed. In addition, toner flight and graphic fog were observed, and it was confirmed that the sufficient electrifiability was not obtained.

In addition, the peelability with a fixing device was better, and occurrence of the uneven glossiness deriving from peeling defect of the fixed image was not observed. However, the fixed image was bent into two parts, and extended again and, thereupon, image defect was observed.

Comparative Example 5

An image was formed with a modified Laser Press 4161 machine (manufactured by Fuji Xerox Co., Ltd.) using a toner 13 by adjusting a toner carrying amount to 4.5 g/m$^2$, and was fixed at a Nip width of 6.5 mm and a fixing rate of 240 mm/sec using a high speed/low pressure/low power-type fixing device shown in FIG. 2.

The resulting image was assessed, and a degree of blackness of this image was insufficient, and a precise image was not observed. In addition, toner flight and graphic fog were not observed, and it was confirmed that the sufficient electrifiability was obtained.

In addition, the peelability with a fixing device was poor, and the uneven glossiness occurred deriving from peeling defect of the fixed image. Further, offset occurred. However, the fixed image was bent into two parts, and extended again and, thereupon, image defect was not observed.

Comparative Example 6

An image was formed with a modified Laser Press 4161 machine (manufactured by Fuji Xerox Co., Ltd.) using a toner 14 by adjusting a toner carrying amount to 4.5 g/m$^2$, and was fixed at a Nip width of 6.5 mm and a fixing rate of 240 mm/sec using a high speed/low pressure/low power-type fixing device shown in FIG. 2.

The resulting image was assessed, and a degree of blackness of this image was sufficient, but a precise image was not observed. In addition, toner flight and graphic fog were observed, and it was confirmed that the sufficient electrifiability was not obtained.

In addition, the peelability with a fixing device was better, but Wax offset occurred deriving from Wax. In addition, the fixed image was bent into two parts, and extended again and, thereupon, image defect was also observed.

Comparative Example 7

An image was formed with a modified Laser Press 4161 machine (manufactured by Fuji Xerox Co., Ltd.) using a toner 15 by adjusting a toner carrying amount to 4.5 g/m$^2$, and was fixed at a Nip width of 6.5 mm and a fixing rate of 240 mm/sec using a high speed/low pressure/low power-type fixing device shown in FIG. 2.

The resulting image was assessed, and a degree of blackness of this image was not sufficiently obtained, and a precise image was not obtained. In addition, toner flight and graphic fog were not observed, and it was confirmed that the sufficient electrifiability was obtained.

In addition, the peelability with a fixing device was better, but Wax offset occurred deriving from Wax. In addition, the fixed image was bent into two parts, and extended again and, thereupon, image defect was also observed.

Example A

A fixing machine of Laser Press 4161 (manufactured by Fuji Xerox Co., Ltd.) was modified so that the fixing temperature became variable, and the low temperature fixability of toner A was assessed. A fixed image was prepared at a set fixing machine temperature, the image surface of each of the resulting fixed images was folded into a valley shape, the degree of image peeling at the folded portion was observed, and the lowest fixing temperature at which an image was hardly peeled was measured as MFT (° C.), which was used as assessment of the low temperature fixability.

A lowest fixing temperature of this toner was 100° C., the peelability with a fixing device was better, it was confirmed that there was peeling without no resistance, and no offset occurred. In addition, the fixed image was bent into two parts, and extended again and, thereupon, image defect was not observed. Further, upon image formation, toner flight and graphic fog were not observed. The image forming method is an image forming method comprising an electrifying step of electrifying the surface of an image supporting member, an electrostatic latent image forming step of forming an electrostatic latent image corresponding to image information on the surface of the electrified image supporting member, a developing step of developing the electrostatic latent image formed on the surface of the image supporting member with a developer containing at least a toner to obtain a toner image, and a fixing step of fixing the toner image onto the surface of a recording medium (the same, hereinafter). In addition, a toner A was filled into a toner cartridge of Laser Press 4161 (manufactured by Fuji Xerox Co., Ltd.), copying was performed over a long term, and the better image was continuously obtained.

Example B

A fixing machine of Laser Press 4161 (manufactured by Fuji Xerox Co., Ltd.) was modified so that the fixing temperature became variable, and the low temperature fixability of a toner B was assessed.

The lowest fixing temperature of this toner was 120° C., the peelability with a fixing device was better, it was confirmed that there was peeling without any resistance and no offset occurred. In addition, the fixed image was bent into two parts, and extended again, and thereupon, no image defect was observed. Further, upon image formation, toner flight and graphic fog were not observed.

Example C

A fixing machine of Laser Press 4161 (manufactured by Fuji Xerox Co., Ltd.) was modified so that a fixing temperature became variable, and the low temperature fixability of a toner C was assessed.

The lowest fixing temperature of this toner was 100° C., the peelability with a fixing device was better, it was confirmed that there was peeling without any resistance, and no offset occurred. In addition, the fixed image was bent into two parts, and extended again, and thereupon, no image defect was observed. Further, upon image formation, toner flight and graphic fog were not observed.

Example D

A fixing machine of Laser Press 4161 (manufactured by Fuji Xerox Co., Ltd.) was modified so that the fixing temperature became variable, and the low temperature fixability of toner D was assessed.

The lowest fixing temperature of this toner was 100° C., the peelability with a fixing device was better, it was confirmed that there was peeling without any resistance, and no offset occurred. In addition, the fixed image was bent into two parts, and extended again, and thereupon, no image defect was observed. Further, upon image formation, toner flight and graphic fog were not observed.

Example E

A fixing machine of Laser Press 4161 (manufactured by Fuji Xerox Co., Ltd.) was modified so that a fixing temperature became variable, and the low temperature fixability of a toner E was assessed.

The lowest fixing temperature of this toner was 100° C., the peelability with a fixing device was better, it was confirmed that there was peeling without any resistance, and no offset occurred. In addition, the fixed image was bent into two parts, and extended again, and thereupon, no image defect was observed. Further, upon image formation, toner flight and graphic fog were not observed.

Example F

A fixing machine of Laser Press 4161 (manufactured by Fuji Xerox Co., Ltd.) was modified so that the fixing temperature became variable, and the low temperature fixability of toner F was assessed.

The lowest fixing temperature of this toner was 100° C., the peelability with a fixing device was better, it was confirmed that there was peeling without any resistance and no offset occurred. In addition, the fixed image was bent into two parts, and extended again, and thereupon, image defect was not observed. Further, upon image formation, toner flight and graphic fog were not observed.

Comparative Example G

A fixing machine of Laser Press 4161 (manufactured by Fuji Xerox Co., Ltd.) was modified so that the fixing temperature became variable, and the low temperature fixability of toner G was assessed.

The lowest fixing temperature of this toner was 100° C., the peelability with this fixing device was poor, and the uneven glossiness deriving from peeling defect of the fixed image occurred. Further, offset occurred. The fixed image was bent into two parts, and extended again, and thereupon, no image defect was observed.

Comparative Example H

A fixing machine of Laser Press 4161 (manufactured by Fuji Xerox Co., Ltd.) was modified so that a fixing temperature became variable, and the low temperature fixability of a toner H was assessed.

The lowest fixing temperature of this toner was 100° C., the peelability with this fixing device was poor, and the uneven glossiness deriving from peeling defect of the fixed image occurred. Further, offset occurred. The fixed image was bent into two parts, and extended again, and thereupon, image defect was not observed.

From these Examples, it can be seen that toners using specific magnetic metal particles have the better hue, a high degree of blackness, and the excellent electrifiability.

In addition, it is also found that, in toners shown in Examples, no flight occurs, a precise image is obtained, and there is no scatter in the peelability depending on a temperature at oil-less fixation and, thus, these toners are excellent in the fixing properties such as the fixed image adherability to a fixing sheet, the peelability of a sheet on which fixation is performed, and the resistance HOT (hot offset).

As described above, according to the invention, there can be provided a toner for electrostatic charged image development which is a toner containing magnetic metal particles, is better in hue, has a high degree of blackness, and is excellent in the electrifiability and the fixability, and a process for preparing the same, as well as an image forming method, an image forming apparatus and a toner cartridge.

What is claimed is:

1. A toner for electrostatic charged image development, which comprises at least a binder resin, a mold releasing agent and magnetic metal particles, wherein the solubility of the magnetic metal particles in a 1 mol/l aqueous $HNO_3$ solution at 50° C. is 500 mg/g·l or less.

2. A toner for electrostatic charged image development according to claim 1, wherein an average particle diameter of the magnetic metal particles is 50 nm to 250 nm.

3. A toner for electrostatic charged image development according to claim 1, wherein an amount of the magnetic metal particles to be added is 5 to 50% by mass.

4. A toner for electrostatic charged image development according to claim 1, wherein the surfaces of the magnetic metal particles have 1 or more covering layer(s), and the covering layer contains at least one element selected from Si, Ti, Ca, P and Sr.

5. A toner for electrostatic charged image development according to claim 4, wherein the surface of the covering layer formed on the magnetic metal particles has $SO^{3-}$ and/or $COO^{-}$ as a polar group, an acid value of the magnetic metal particles obtained by KOH titration is 2.5 to 6.0 meq/mg-KOH, and a difference between an acid value of the magnetic metal particles and that of the binder resin is 0.5 to 6.0 meq/mg-KOH.

6. A toner for electrostatic charged image development according to claim 1, wherein a shape coefficient (SF1) of the toner is 110 to 140.

7. A toner for electrostatic charged image development according to claim 1, wherein a volume average particle size distribution index GSDv of the toner is 1.3 or less.

8. A toner for electrostatic charged image development according to claim 1, wherein a storage modulus $G'_1$ of a toner at 180° C. obtained from measurement of dynamic viscoelasticity at a frequency of 6.28 rad/s in a sine wave vibration method is $1\times10^3$ to $1\times10^5$ Pa, and a ratio of a storage modulus $G'_1$ of the toner and a storage modulus $G'_2$ (Pa) of the toner at 180° C. obtained from measurement of dynamic viscoelasticity at a frequency of 62.8 rad/s in a sine wave vibration method ($G'_2/G'_1$) is 1.0 to 2.5.

9. A toner for electrostatic charged image development according to claim 1, wherein a storage modulus of the toner at an angular frequency of 1 rad/s and 120° C. is $1\times10^5$ Pa or lower, and a melt viscosity of the toner at 120° C. is $5\times10^4$ Pa·s or higher.

10. A toner for electrostatic charged image development according to claim 1, wherein the binder resin is a crystalline binder resin.

11. A toner for electrostatic charged image development according to claim 10, wherein a storage modulus $G'_1$ of the toner at 180° C. obtained from measurement of dynamic viscoelasticity at a frequency of 6.28 rad/s in a sine wave vibration is $1\times10^3$ to $1\times10^5$ Pa, and a ratio of a storage modulus $G'_1$ of the toner and a storage modulus $G'_2$ (Pa) at 180° C. obtained from measurement of dynamic viscoelasticity at a frequency of 62.8 rad/s in a sine wave vibration method ($G'_2/G'_1$) is 1.0 to 5.0.

12. A toner for electrostatic charged image development according to claim 10, wherein a storage modulus of the toner at an angular frequency of 6.28 rad/s and 120° C. is 50 to $1\times10^5$ Pa, and a melt viscosity of the toner at 120° C. is 100 Pa·s or higher.

13. A toner for electrostatic charged image development according to claim 1, wherein a viscosity of the mold releasing agent at 180° C. is 15 mPa·s or lower, an endothermic maximum of the toner obtained by differential thermo analysis is 70 to 120° C., and a content of a mold releasing agent obtained from an area of the endothermic peak is 5 to 30% by mass.

14. A toner cartridge which is detachably mounted on an image forming apparatus, and accommodates at least a toner to be supplied to developing means provided in the image forming apparatus, wherein:

the toner contains at least a binder resin, a mold releasing agent and magnetic metal particles, and the solubility of the magnetic metal particles in a 1 mol/l aqueous $HNO_3$ solution at 50° C. is 500 mg/g·l or less.

15. An image forming method comprising: at least an electrifying step of electrifying the surface of an image supporting member, an electrostatic latent image forming step of forming an electrostatic latent image corresponding to image information on the surface of the electrified image supporting member, a developing step of developing the electrostatic latent image formed on the surface of the electrified image supporting member with a developer containing at least a toner to obtain a toner image, and a fixing step of fixing the toner image onto the surface of a recording medium, wherein:

the toner contains at least a binder resin, a mold releasing agent and magnetic metal particles, and the solubility of the magnetic metal particles in a 1 mol/l aqueous $HNO_3$ solution at 50° C. is 500 mg/g·l or less.

16. An image forming apparatus comprising at least electrifying means for electrifying the surface of an image supporting member, electrostatic latent image forming means for forming an electrostatic latent image corresponding to image information on the surface of the electrified image supporting member, developing means of developing the electrostatic latent image formed on the surface of the electrified image supporting member with a developer containing at least a toner to obtain a toner image, and fixing means fixing the toner image onto the surface of a recording medium, wherein:

the toner contains at least a binder resin, a mold releasing agent and magnetic metal particles, and the solubility of the magnetic metal particles in a 1 mol/l aqueous $HNO_3$ solution at 50° C. is 500 mg/g·l or less.

17. A process for preparing a toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or less, which comprises:

an aggregation step of mixing a resin particle dispersion in which at least resin particles of 1 μm or smaller are dispersed, a magnetic metal particle dispersion in which magnetic metal particles are dispersed, and a mold releasing agent particle dispersion in which mold releasing agent particles are dispersed, to form aggregated particles of resin particle, magnetic metal particles and mold releasing agent particles, and a fusion/coalescence step of heating the aggregated particles to a temperature equal to or greater than the glass transition point or melting point of the resin particles to fuse and coalesce the particles.

18. A process for preparing a toner for electrostatic charged image development according to claim 17, wherein the aggregation step comprises a first aggregation step of mixing a resin particle dispersion in which at least first resin particles having a particle diameter of 1 μm or smaller are dispersed, a magnetic metal particle dispersion in which magnetic metal particles are dispersed, and a mold releasing agent particle dispersion in which mold releasing agent particles are dispersed, to form core aggregated particles containing the first resin particles, magnetic metal particles and mold releasing agent particles, and a second aggregation step of forming a shell layer containing second resin particles on the surface of the core aggregated particles to obtain core/shell aggregated particles.

19. A process for preparing a toner for electrostatic charged image development according to claim 17, wherein in the aggregation step, upon mixing of the respective dispersions, at least one kind of metal salt polymer is added, the metal salt polymer is a polymer of a tetra-valent aluminium salt, or a mixture of a polymer of a tetra-valent aluminium salt and a polymer of a tri-valent aluminium salt, and their concentrations are 0.11 to 0.25% by mass.

20. A process for preparing toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or less, which comprises:

applying mechanical shearing force to a dispersion containing at least a polymerizable monomer, a polymerization initiator, a mold releasing agent and magnetic metal particles in the presence of an inorganic or organic dispersing agent, to suspend the dispersion, and applying thermal energy to polymerize the material while applying stirring shear, to obtain toner particles.

21. A process for preparing a toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or less, which comprises:

dispersing a polymerizable monomer, a polymerization initiator, a mold releasing agent and magnetic metal particles in a polymer solution obtained by pre-polymerizing a polymerizable monomer in advance so that a weight average molecular weight becomes 3000 to 15000, applying a mechanical shearing force to this dispersion in the presence of an inorganic or organic dispersing agent, to suspend the material, and applying thermal energy while applying stirring shear, to polymerize the material to obtain toner particles.

22. A process for preparing toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or les, which comprises:

applying a mechanical shearing force to a solution in which a binder resin, a mold releasing agent and magnetic metal particles are dissolved in an organic solvent in the presence of an inorganic or organic dispersing agent, to suspend the solution, and performing desolvation to obtain toner particles.

23. A process for preparing toner for electrostatic charged image development which contains at least a binder resin, a mold releasing agent and magnetic metal particles, and in which the solubility of the magnetic metal particles in a 1 mol/l aqueous $HNO_3$ solution at 50° C. is 500 mg/g·l or less, which comprises:

a step of applying a mechanical shearing force to a solution in which a binder resin is dissolved in an organic solvent in the presence of an anionic surfactant, to emulsify and desolvate the solution, applying a mechanical shearing force in the presence of an anionic surfactant to obtain resin particles of at least 1 μm or smaller, and cooling the material to not more than 50° C. to prepare a resin particle dispersion solution, an aggregation step of mixing the resin particle dispersion solution, a magnetic metal particle dispersion in which magnetic metal particles are dispersed, and a mold releasing agent particle dispersion in which mold releasing agent particles are dispersed, to form aggregated particles of resin particles, magnetic metal particles and mold releasing agent particles, and a fusion/coalescence step of heating the aggregated particle to a temperature not lower than the glass transition point or melting point of the resin particles to fuse and coalesce the particles.

24. A process for preparing a toner for electrostatic charged image development according to claim 23, wherein in the aggregation step, upon mixing of the respective dispersions, at least one kind metal salt polymer is added, the metal salt polymer is a polymer of a tetra-valent aluminium salt, or a mixture of a polymer of a tetra-valent aluminium salt and a polymer of a tri-valent aluminium salt, and their concentrations are 0.11 to 0.25% by mass.

* * * * *